US011839311B2

(12) United States Patent
Park

(10) Patent No.: US 11,839,311 B2
(45) Date of Patent: Dec. 12, 2023

(54) CHAIR INCLUDING MULTI-CHANNEL SOUND SYSTEM

(71) Applicant: TROUND INC., Hanam-si (KR)

(72) Inventor: Jea Bum Park, Namyangju-si (KR)

(73) Assignee: TROUND INC., Hanam-si (KR)

( * ) Notice: Subject to any disclaimer, the term of this patent is extended or adjusted under 35 U.S.C. 154(b) by 0 days.

(21) Appl. No.: 18/155,956

(22) Filed: Jan. 18, 2023

(65) Prior Publication Data

US 2023/0148758 A1 May 18, 2023

Related U.S. Application Data

(63) Continuation of application No. PCT/KR2021/011071, filed on Aug. 20, 2021.

(30) Foreign Application Priority Data

Aug. 21, 2020 (KR) ..... 10-2020-0105177
Sep. 2, 2020 (KR) ..... 10-2020-0111831

(51) Int. Cl.

| | |
|---|---|
| ***A47C 7/72*** | (2006.01) |
| ***H04R 5/02*** | (2006.01) |
| ***A47C 7/38*** | (2006.01) |
| ***A47C 7/40*** | (2006.01) |

(52) U.S. Cl.
CPC ..... *A47C 7/727* (2018.08); *A47C 7/38* (2013.01); *A47C 7/40* (2013.01); *H04R 5/02* (2013.01); *H04R 5/023* (2013.01)

(58) Field of Classification Search
CPC ..... H04R 5/02; H04R 5/023; A47C 7/727
USPC ..... 297/300–307, 217.4; 381/300–307
See application file for complete search history.

(56) References Cited

U.S. PATENT DOCUMENTS 4,075,438 A * 2/1978 Kappel ..... H04R 5/023 381/301
4,440,443 A * 4/1984 Nordskog ..... B60N 2/882 297/217.4
5,143,055 A * 9/1992 Eakin ..... A61H 23/0236 297/217.4
5,838,808 A * 11/1998 Prosser ..... H04R 5/023 381/388
5,887,071 A * 3/1999 House ..... H04R 5/02 381/87

(Continued)

FOREIGN PATENT DOCUMENTS

JP 2006-345477 A 12/2006
JP 2008-271600 A 11/2008

(Continued)

OTHER PUBLICATIONS

International Search Report issued in PCT/KR2021/011071; dated Nov. 12, 2021.

(Continued)

*Primary Examiner* — Rodney B White
(74) *Attorney, Agent, or Firm* — Studebaker & Brackett PC

(57) ABSTRACT

The present disclosure relates to a chair including a multi-channel sound system, and more particularly, to a chair including a multi-channel sound system capable of providing a sense of space and a three-dimensional effect to a user who sits in the chair through sounds output from a plurality of channels.

16 Claims, 17 Drawing Sheets

(56) References Cited

U.S. PATENT DOCUMENTS

| | | | | |
|---|---|---|---|---|
| 5,889,875 | A * | 3/1999 | Caron | A47C 7/727 381/345 |
| 6,145,926 | A * | 11/2000 | Lin | A47C 7/723 297/217.3 |
| 6,744,898 | B1 * | 6/2004 | Hirano | H04R 5/023 381/301 |
| 7,424,127 | B1 * | 9/2008 | Holmi | H04R 5/023 381/86 |
| 7,899,198 | B2 * | 3/2011 | Holmi | H04R 5/023 381/86 |
| 8,295,535 | B2 * | 10/2012 | Tracy | A47C 7/727 381/86 |
| 8,596,599 | B1 * | 12/2013 | Carson | F16M 11/2085 248/920 |
| 9,555,890 | B2 * | 1/2017 | Tracy | B64D 11/00154 |
| 9,950,793 | B2 * | 4/2018 | Tracy | H04R 5/023 |
| 10,575,076 | B2 * | 2/2020 | Hudson, III | H04R 5/023 |
| 10,715,895 | B2 * | 7/2020 | Tracy | H04R 1/025 |
| 10,820,103 | B1 * | 10/2020 | Hudson, III | H04R 5/023 |
| 11,086,394 | B2 * | 8/2021 | Lin | H04R 1/403 |
| 11,290,835 | B2 * | 3/2022 | Nakagawa | H04R 5/04 |
| 11,357,332 | B2 * | 6/2022 | Chalfin | H04R 1/2834 |
| 2005/0190935 | A1 * | 9/2005 | Sakamoto | H04R 5/02 381/86 |
| 2008/0187156 | A1 * | 8/2008 | Yokota | H04R 1/025 381/307 |
| 2009/0154737 | A1 * | 6/2009 | Ostler | A47C 7/72 381/301 |
| 2009/0206641 | A1 * | 8/2009 | Brown, Jr. | A47C 7/723 297/217.3 |
| 2012/0223555 | A1 * | 9/2012 | Brown, Jr. | A47C 7/72 297/217.4 X |
| 2018/0201373 | A1 | 7/2018 | Tracy | |
| 2019/0125087 | A1 * | 5/2019 | Aizawa | H04S 7/00 |
| 2020/0155793 | A1 * | 5/2020 | Chen | H04R 1/2803 |
| 2021/0112341 | A1 * | 4/2021 | Nelson | A47C 7/72 |
| 2021/0127841 | A1 * | 5/2021 | Park | A47C 7/727 |
| 2022/0141589 | A1 * | 5/2022 | O'Polka | H04R 1/323 381/304 |
| 2023/0054544 | A1 * | 2/2023 | Park | A47C 7/727 |
| 2023/0059033 | A1 * | 2/2023 | Park | H04R 1/025 |
| 2023/0165378 | A1 * | 6/2023 | Park | H04R 1/026 297/217.4 |
| 2023/0179918 | A1 * | 6/2023 | Park | A47C 7/727 381/301 |

FOREIGN PATENT DOCUMENTS

| | | | | |
|---|---|---|---|---|
| JP | 2016-134794 | A | 7/2016 | |
| KR | 20100071321 | A * | 6/2010 | A47C 7/727 |
| KR | 10-1991425 | B1 | 6/2019 | |

OTHER PUBLICATIONS

"Request for the Submission of an Opinion" Office Action issued in KR 10-2020-0105177; mailed by the Korean Intellectual Property Office dated Oct. 28, 2021.

"Written Decision on Registration" Office Action issued in KR 10-2020-0105177; mailed by the Korean Intellectual Property Office dated Jan. 11, 2022.

* cited by examiner

CHAIR INCLUDING MULTI-CHANNEL SOUND SYSTEM

CROSS-REFERENCE TO RELATED APPLICATION

This application is based on the PCT Application No. PCT/KR2021/011071, filed on Aug. 20, 2021, and claims the benefit of priority from the prior Korean Patent Application No. 10-2020-0105177, filed on Aug. 21, 2020 and the prior Korean Patent Application No. 10-2020-0111831, filed on Sep. 2, 2020, the disclosures of which is incorporated herein by reference in its entirety.

BACKGROUND

1. Field of the Invention

The present invention relates to a chair including a multi-channel sound system, and more particularly, to a chair including a multi-channel sound system capable of providing a sense of space and a three-dimensional effect to a user who sits in the chair through sounds output from a plurality of channels.

2. Discussion of Related Art

In general, a speaker used while being connected to a computer generates sound by converting a current flowing through a wire into an electrical signal and a vibration signal and generating vibrations using a vibration portion.

For example, when watching a movie or playing a game using a computer, a user not only watches images on a screen of the computer but also listens to sounds due to an electrical signal being transferred and vibrations generated by a speaker corresponding to the images being transferred to ears of the user while the user sits in a chair where a monitor of the computer is seen.

Particularly, a multi-channel sound system including a plurality of such speakers has an advantage of allowing a user to more exquisitely experience a direction, level, and the like of a sound in an image.

However, in order to implement such multi-channel sound systems, it is necessary to provide a plurality of speakers above and below a desk, behind a chair, and the like and to electrically connect all of the plurality of speakers such that there is a great restriction in space.

Also, although a multi-channel sound system is implemented by arranging the plurality of speakers, there is a problem that a position of the chair is changed or a variety of physical interferences are present between the speakers and the user who sits in the chair.

SUMMARY OF THE INVENTION

The present invention is directed to providing a chair including at least 1) a backrest portion configured to support a back and waist part of a user and 2) a seat portion configured to support a buttocks part and a part of legs of the user, the chair including at least one main frame extending a predetermined length toward a front from the backrest portion, wherein a multi-channel sound system is implemented as a first speaker installation area in which at least one speaker is installed is defined in a direction in which the main frame extends.

The objectives of the present invention are not limited to the above-mentioned objectives, and other unmentioned objectives and advantages of the present invention should be understood from the description below and should be more clearly understood from embodiments of the present invention. Also, those of ordinary skill in the art should easily understand that the objectives and advantages of the present invention may be realized by means shown in the claims below and combinations thereof.

According to one aspect of the present invention, there is provided a chair including at least 1) a headrest portion configured to support a head part of a user, 2) a backrest portion configured to support a back and waist part of the user, 3) a seat portion configured to support a buttocks part and a part of legs of the user, and 4) side support portions configured to support sides of the user, the chair including at least one main frame which is installed in an arbitrary area of the chair and has a shape that passes by a side of the user sitting in the chair and extends toward a front of the user, wherein a first speaker installation area in which at least one speaker is installed is defined in a direction in which the main frame extends.

In one embodiment, a main frame rotating shaft may be provided inside or behind the headrest portion, the backrest portion, or the seat portion, and the main frame may be provided to be connected to the main frame rotating shaft to be rotatable within a predetermined angle range in an axial direction of the main frame rotating shaft.

In another embodiment, an installation frame having a shape that extends in a vertical direction may be provided inside or behind the headrest portion, the backrest portion, or the seat portion, and the main frame may be provided to be connected to the installation frame to be able to move upward or downward in a direction in which the installation frame extends.

In still another embodiment, the main frame may be installed on at least one selected from the backrest portion, the seat portion, and the side support portions, at least one head frame having a shape that passes by a portion above a user sitting in the chair and extends toward a front of the user may be installed on the headrest portion, and a second speaker installation area in which at least one speaker is installed may be defined in a direction in which the head frame extends.

In yet another embodiment, an installation frame having a shape that extends in a vertical direction may be provided on the side support portions, the main frame may be installed on the installation frame with a main frame rotating shaft as a medium, and the main frame may be provided to be connected to the main frame rotating shaft to be rotatable within a predetermined angle range in an axial direction of the main frame rotating shaft.

According to the present invention, there is an advantage that a user can experience vivid sounds like those existing in actually reproduced images or game environments just by sitting in a chair.

In particular, since it is possible to transfer generated sounds to the user while the sounds are separated in a variety of directions such as frontward, rearward, sideward, upward, downward directions, and the like in reproduced images or game environments according to positions and the number of speakers provided in the chair, a true multi-channel sound system can be implemented.

Specific advantageous effects of the present invention, in addition to the advantageous effects described above, will be described below in the description of details for carrying out the invention.

DETAILED DESCRIPTION OF EXEMPLARY EMBODIMENTS

Hereinafter, a chair including a multi-channel sound system according to some embodiments of the present invention will be described in detail with reference to the accompanying drawings. Also, each piece of content relating to the chair according to some embodiments of the present invention described with reference to the accompanying drawings should be understood as an independent embodiment, and at least two independent embodiments may be combined when necessary.

Meanwhile, components of a previously-described embodiment or an embodiment to be described may be referenced for components insufficiently described through the accompanying drawings.

Figure 1:
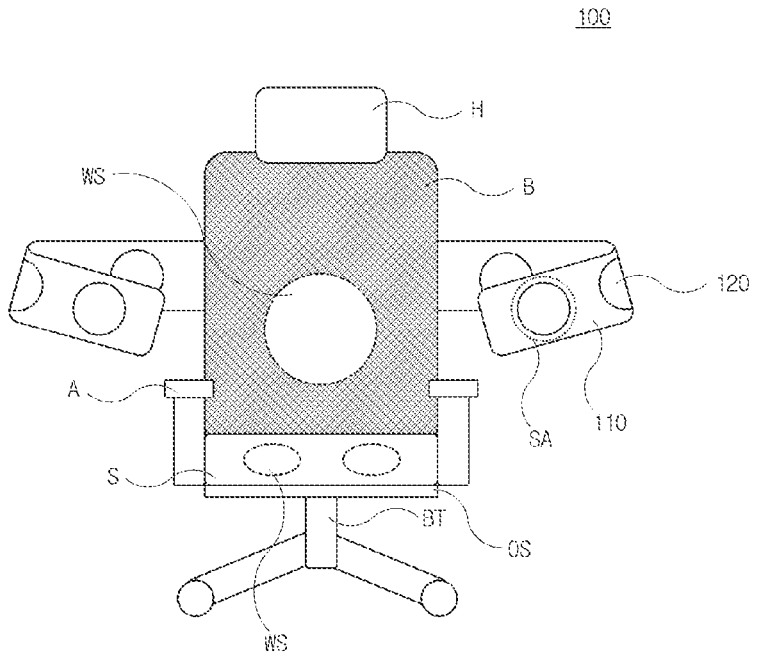
FIG. 1 is a front view of a chair according to one embodiment of the present invention.
Figure 2:
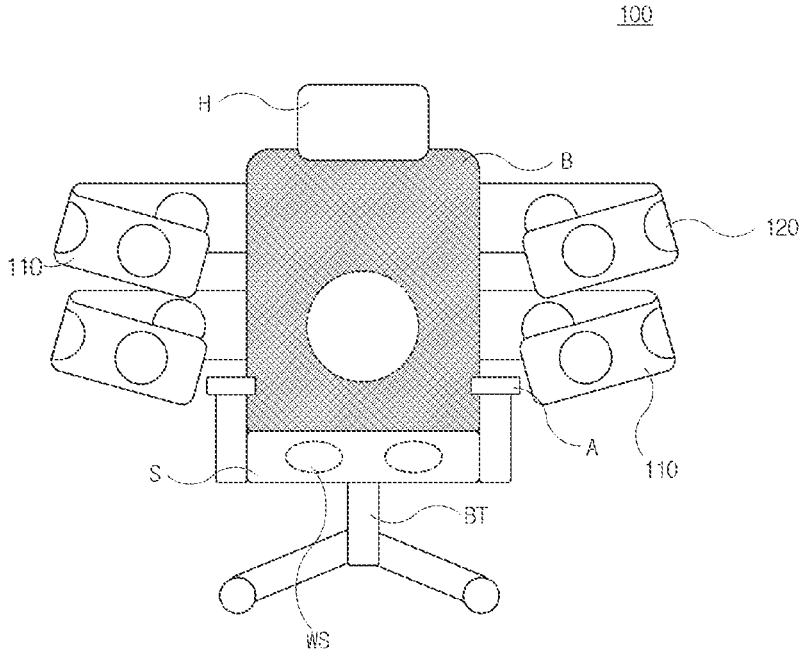
FIG. 2 is a front view of a chair according to another embodiment of the present invention.
Figure 3:
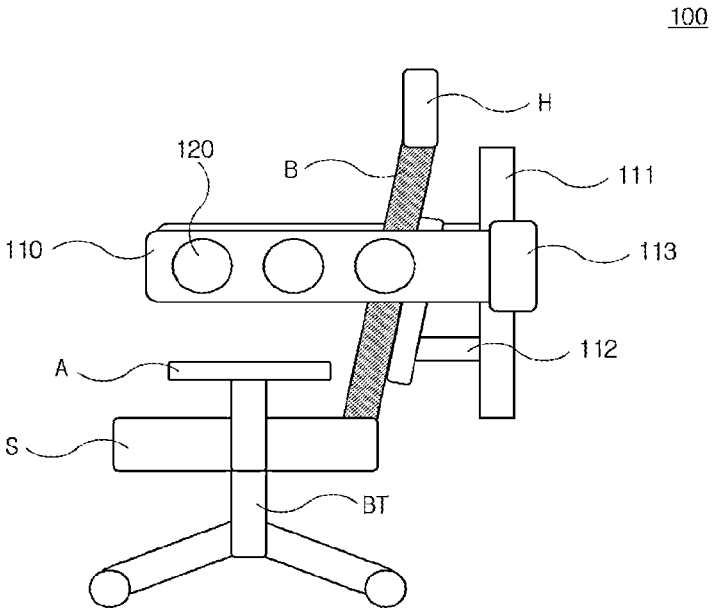
FIG. 3 is a lateral view of a chair according to still another embodiment of the present invention.
Figure 4:
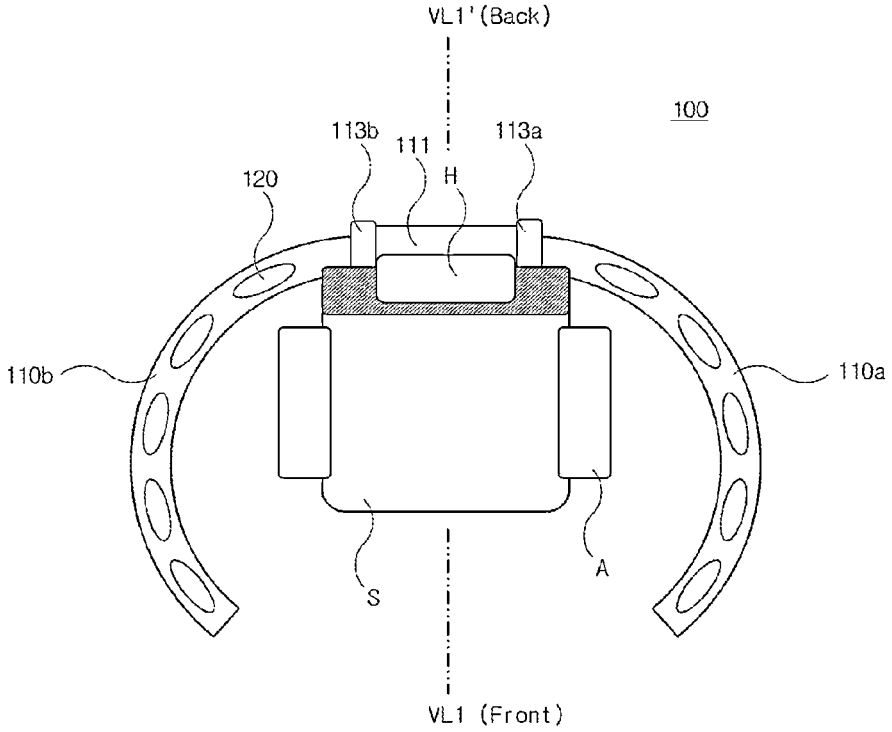
FIGS. 4 and 5 are top views of the chair illustrated in FIG. 3.
Figure 5:
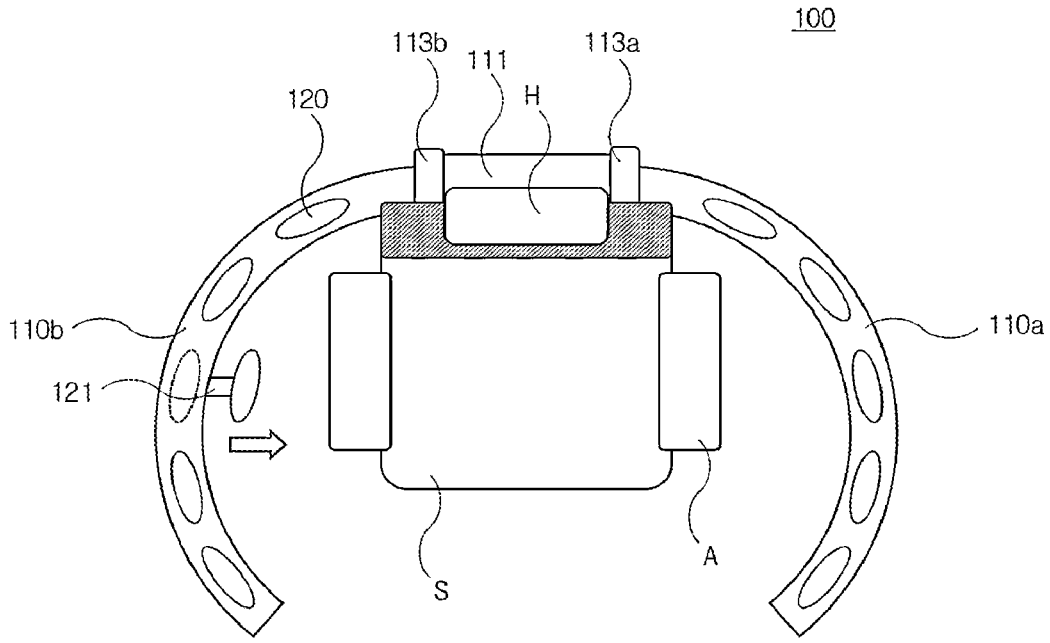

FIG. 1 is a front view of a chair according to one embodiment of the present invention, FIG. 2 is a front view of a chair according to another embodiment of the present invention, FIG. 3 is a lateral view of a chair according to still another embodiment of the present invention, and FIGS. 4 and 5 are top views of the chair illustrated in FIG. 3.

Referring to FIGS. 1 to 5, a chair 100 includes at least 1) a headrest portion H configured to support a head part of a user who sits in the chair 100, 2) a backrest portion B configured to support a back and waist part of the user, 3) a seat portion S configured to support a buttocks part and a part of legs of the user, and 4) side support portions A configured to support sides of the user.

Although the chair 100 is illustrated as a movable chair, in which a movable member BT is provided below the seat portion S, in the accompanying drawings, the present invention is not necessarily limited thereto, and the chair 100 may also be provided in the form of an immovable chair, e.g., sofa.

The headrest portion H installed above the backrest portion B may be configured to be detachable from the backrest portion B or integrally formed with the backrest portion B as necessary.

For comfort of the user who sits in the chair 100, the headrest portion H, the backrest portion B, and/or the seat portion S may be provided in the form in which a front or inside (that is, a part which comes into contact with the back, waist, and side parts of the user) is formed of a cushioning material or has a cushioning material added thereon.

Also, a woofer speaker WS may be additionally provided on the backrest portion B and/or the seat portion S. In a case in which the woofer speaker WS is provided on the backrest portion B and/or the seat portion S, since vibrations generated by the woofer speaker WS can be directly transferred to the user who sits in the chair 100, a more vivid user experience can be provided. The woofer speaker WS provided on the inside of the backrest portion B and/or the seat portion S may be installed as many as the number necessary to implement the multi-channel sound system. The woofer speaker WS may be installed in at least one area selected from a front surface, a rear surface, a side surface, and the inside of the backrest portion B and/or the seat portion S.

Although not separately illustrated in the drawings, for comfort of the user who sits in the chair 100, at least one selected from a warmer, a ventilator, and a massager may be provided on the backrest portion B and/or the seat portion S.

Meanwhile, a vibration dampening member OS may be selectively provided between the seat portion S and the movable member BT. The vibration dampening member OS serves to prevent or reduce transmission of vibrations, generated from a plurality of speakers disposed above the seat portion S, to a portion below the chair 100. The vibration dampening member OS is provided as a material which can adsorb vibrations, such as a spring, cushion, or foam.

At least one main frame 110 having a shape that passes by a side of the user sitting in the chair 100 and extends toward a front of the user is installed in an arbitrary area of the chair 100.

Here, the arbitrary area of the chair 100 in which the main frame 110 is installed refers to the headrest portion H, the backrest portion B, the seat portion S, and/or the side support portions A that constitute the chair 100.

Hereinafter, first, an embodiment in which the main frame 110 is installed on the backrest portion B will be described.

At least one main frame 110 extending a predetermined length toward a front may be installed on the backrest portion B, and a first speaker installation area SA in which at least one speaker 120 is installed may be defined in a direction in which the main frame 110 extends. Here, the direction toward the front is a direction toward the front of the user who sits in the chair 100 and refers to a direction toward arbitrary positions placed relatively in front of at least both sides of the user who sits in the chair 100. That is, in this case, one end portion of the main frame 110 that is not fixed to the chair 100 may be positioned in a field of vision in front of the user who sits in the chair 100. In this way, since the main frame 110 has a shape that surrounds the user sitting in the chair 100 while spaced a predetermined distance apart from the user, it is possible to implement an effect that sounds implemented by the at least one speaker 120 installed in the main frame 110 are generated from an arbitrary space surrounding the user.

For example, referring to FIG. 1, the main frame 110 may be installed inside or behind the backrest portion B, the first speaker installation area SA may be defined in the direction in which the main frame 110 extends, and at least one speaker 120, which may be a plurality of speakers 120, may be installed in the first speaker installation area SA.

In a case in which the main frame 110 is installed inside the backrest portion B, the main frame 110 may have a shape that protrudes in at least one of both side directions of the backrest portion B and extends a predetermined length toward a front of the chair 100.

Meanwhile, in a case in which the main frame 110 is installed behind the backrest portion B, a separate support member configured to fix the main frame 110 and the backrest portion B may be interposed to withstand a load of the main frame 110. In this case, the main frame 110 may have a shape that is installed on the separate support member and extends a predetermined length from behind the backrest portion B toward the front of the chair 100.

The main frame 110 installed on the backrest portion B may be installed as many as the number necessary to implement the multi-channel sound system. For example, as illustrated in FIG. 2, two main frames 110 may be installed inside or behind the backrest portion B.

Meanwhile, the speaker 120 may be integrally provided with the main frame 110 or provided to be detachable from the main frame 110. Also, in another modified example, the main frame 110 may be configured by connecting a plurality of speakers 120 to each other.

Here, the speakers 120 may be speakers in the form of a complete product, speaker units connected to driving portions separately provided at the first speaker installation areas SA and configured to operate as a complete product, display type speakers, thin-film type speakers, or one-way and multi-way speakers, and the speakers 120 may operate by receiving sound signals through wires or wirelessly. The description of the speakers 120 may be equally applied to speakers provided in a second speaker installation area which will be described below.

Meanwhile, although not separately illustrated in the drawings, in a case in which the speakers receive sounds wirelessly, the chair 100 may include a wireless reception portion. The wireless reception portion may wirelessly transmit or receive sound signals to or from a sound source (for example, home theater, TV, set-top box, sound bar, computer, cellular phone, tablet PC, or the like) using a method such as Wi-Fi, Bluetooth, digital enhanced cordless telecommunications (DECT), Li-Fi, and the like. The wireless reception portion may be provided in a binding portion and/or a connecting portion which will be described below. Meanwhile, the wireless reception portion may be installed in an arbitrary area of the chair 100.

Also, the speakers 120 may be directly installed in the first speaker installation areas SA, but the present invention is not necessarily limited thereto, and an accessory for installing a speaker may be separately provided between the first speaker installation areas SA and the speaker 120.

Meanwhile, the main frame 110 may have a linear shape that extends a predetermined length from the backrest portion B toward the front of the chair 100 (or toward the front of the user sitting in the chair 100 after passing by a side of the user). Also, the main frame 110 may have a nonlinear shape, e.g., various shapes such as a broken-line shape or a curved shape, as necessary. In this case, the main frame 110 may have a form that surrounds the user who sits in the chair 100. Accordingly, in a case in which a plurality of speakers 120 are installed in the main frame 110, it is possible to maintain a constant distance between the plurality of speakers 120 and the user. Also, in a case in which a plurality of speakers 120 with different performance are installed in the main frame 110, it may be possible to adjust a distance between each speaker 120 and the user in consideration of the performance of the speakers 120.

The shape of the main frame 110 may be equally applied to an installation frame, a first main frame, a second main frame, a first sub-frame, a head frame, and a second sub-frame which will be described below, as long as the scope does not deviate from the scope of the present invention.

Referring to FIGS. 3 and 4, a main frame rotating shaft 113 may be positioned inside or behind the backrest portion B, and the main frame 110 may be provided to be connected to the main frame rotating shaft 113 to be rotatable within a predetermined angle range in an axial direction of the main frame rotating shaft 113.

For example, the main frame 110 may be connected to the main frame rotating shaft 113 and rotate on a vertical or horizontal plane. Here, the vertical plane refers to a plane which is vertically orthogonal to an arbitrary horizontal plane parallel to the ground, and the horizontal plane refers to a plane which is parallel to the ground or parallel to an arbitrary horizontal plane parallel to the ground.

Although not separately illustrated in the drawings, according to another modified example of the present invention, the main frame rotating shaft 113 may be provided on both sides of the backrest portion B, and accordingly, two main frames 110 may be individually connected to the main frame rotating shafts 113 each provided on both sides of the backrest portion B and may extend toward the front of the chair 100.

In still another embodiment of the present invention, an installation frame 111 extending in the vertical direction may be positioned inside or behind the backrest portion B, and the main frame 110 may be installed on the installation frame 111.

In a case in which the backrest portion B has a shape bent at a predetermined angle or is bendable, the installation frame 111 may be positioned while spaced apart from the backrest portion B at a predetermined interval in order to maintain an angle of orientation of the main frame 110.

Here, the main frame 110 may be positioned to be parallel to a plane vertical to the ground while spaced apart from the backrest portion B at a predetermined interval, but the present invention is not necessarily limited thereto, and the main frame 110 may be provided to be inclined at a predetermined angle with respect the plane vertical to the ground.

To this end, at least one interval adjustment member 112 may be positioned between the backrest portion B and the installation frame 111. The interval adjustment member 112 serves to simultaneously adjust an interval between the backrest portion B and the installation frame 111 and adjust an angle of the installation frame 111 with respect to the backrest portion B.

Also, the main frame 110 may be installed on the installation frame 111 with the main frame rotating shaft 113 as a medium. In this case, the main frame rotating shaft 113 may be provided to be able to move upward or downward in a direction in which the installation frame 111 extends, and as a result, the main frame 110 connected to the main frame rotating shaft 113 may, along with the main frame rotating shaft 113, move upward or downward in the direction in which the installation frame 111 extends.

Here, the main frame 110 may be detachable from the main frame rotating shaft 113, or the main frame rotating shaft 113 may be provided to be detachable from the installation frame 111 in a state in which the main frame 110 is connected to the main frame rotating shaft 113.

Here, in a case in which the installation frame 111 is positioned inside or behind the backrest portion B, the installation frame 111 and the backrest portion B may be integrally formed. Also, when necessary, the installation frame 111 may be provided to be detachable from the backrest portion B.

Meanwhile, the main frame 110 may be provided as a single member, but as illustrated in FIG. 4, main frames 110*a* and 110*b* positioned at a left side and a right side of the chair 100 may be provided as separate members.

In this case, the main frame 110 may pass through the center of the chair 100 and may include at least one first main frame 110*a* which is positioned at the left side with respect to a virtual reference line VL1-VL1' connecting the front and rear of the chair 100, that is, has a shape that passes by the left side of the user sitting in the chair 100 and extends toward the front of the user, and at least one second main frame 110*b* which is positioned at the right side with respect to the virtual reference line VL1-VL1', that is, has a shape that passes by the right side of the user sitting in the chair 100 and extends toward the front of the user.

Referring to FIG. 5, the speakers 120 installed in the first main frame 110*a* and/or the second main frame 110*b* may be provided to be able to insert or withdraw in a direction oriented toward the user who sits in the chair 100. As described above, in a case in which a plurality of speakers 120 with different performance are installed in the first main frame 110*a* and/or the second main frame 110*b*, when it is necessary to adjust a distance between each speaker 120 and the user in consideration of the performance of the speakers 120, inserting or withdrawing the speakers 120 into or from the first main frame 110*a* and/or the second main frame 110*b* may be useful.

Here, an insertable/withdrawable protruding member 121 may be provided to allow the speakers 120 to protrude from the first speaker installation area SA defined in the first main frame 110*a* and/or the second main frame 110*b*.

Figure 6:
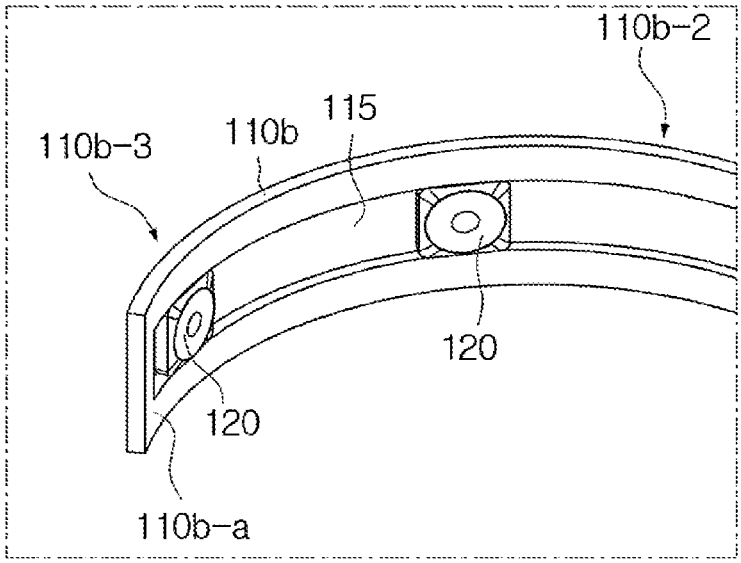
FIG. 6 is a perspective view illustrating one portion of a main frame applied to the chair according to one embodiment of the present invention.

FIG. 6 is a perspective view illustrating one portion of a main frame applied to the chair according to one embodiment of the present invention, and FIG. 7 is a front view illustrating the portion of the main frame applied to the chair according to one embodiment of the present invention. Although FIGS. 6 and 7, for convenience, illustrate only the second main frame 110*b*, the content to be described with reference to FIGS. 6 and 7 is applicable equally to the first main frame and the first sub-frame, the head frame, and the second sub-frame which will be described below.

Referring to FIGS. 6 and 7, at least one speaker 120 installed in the second main frame 110*b* may be installed to be able to slide in a direction in which the second main frame 110*b* extends. Accordingly, there is an advantage that each user may be allowed to customize a sound system for himself or herself by adjusting a position of the at least one speaker 120 installed in the second main frame 110*b*.

Specifically, a sliding space 115 having a shape that is bent in the direction in which the second main frame 110*b* extends may be formed on an inner side surface 110*b-a* of the second main frame 110*b*. The at least one speaker 120 may be installed in the sliding space 115. The sliding space 115 may be formed to pass through the second main frame 110*b* but may also be formed while an outer side surface of the second main frame 110*b* is blocked.

Figure 7A:
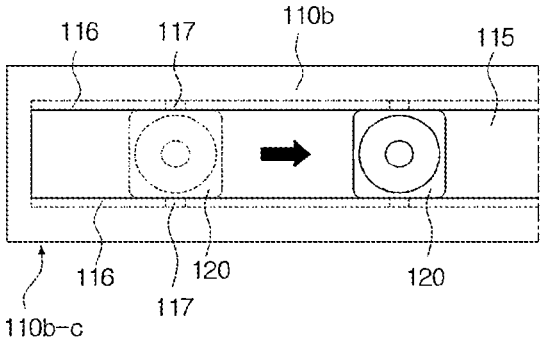
FIGS. 7A and 7B are front views illustrating the portion of the main frame applied to the chair according to one embodiment of the present invention.

Referring to FIG. 7A, a sliding rail 116 may be selectively provided above and/or below the sliding space 115. A sliding member 117 provided above and/or below the speaker 120 installed in the sliding space 115 is installed to be able to slide on the sliding rail 116. The speaker 120 may slide in the direction in which the second main frame 110*b* extends while being stably supported by the sliding rail 116 and additionally in the sliding space 115 by the sliding member 117.

Figure 7B:
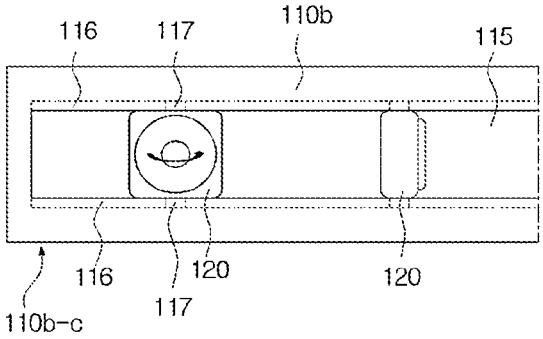

Meanwhile, referring to FIG. 7B, the sliding member 117 may be provided as a rotatable member so that the speaker 120 supported by the sliding rail 116 is rotatable in an axial direction.

Accordingly, the at least one speaker 120 installed in the second main frame 110*b* is, while being slidable in the direction in which the second main frame 110*b* extends, rotatable in the axial direction so as to implement more diverse sound environments.

Figure 8:
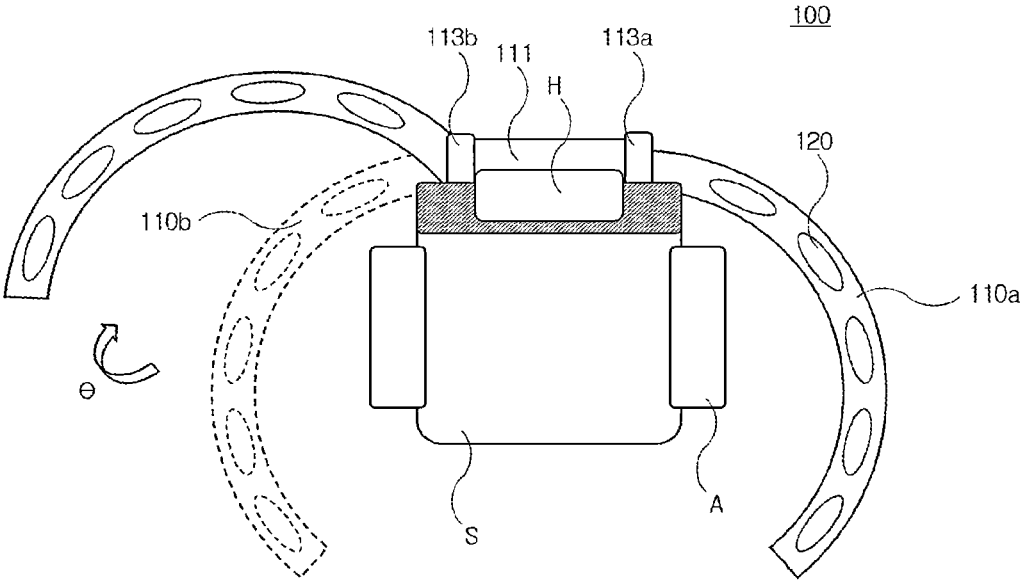
FIG. 8 is a top view of a chair according to yet another embodiment of the present invention.

FIG. 8 is a top view illustrating a rotating operation of a main frame applied to a chair according to yet another embodiment of the present invention. The first main frame 110*a* and/or the second main frame 110*b* may be provided to be connected to main frame rotating shafts 113*a* and 113*b*, respectively, to be independently rotatable within a predetermined angle range on a plane vertical or horizontal to the ground.

For example, the first main frame 110*a* and/or the second main frame 110*b* may be connected to the main frame rotating shafts 113*a* and 113*b*, respectively, to be tilted in an arbitrary direction (e.g., forward, rearward, upward, or downward).

Figure 9:
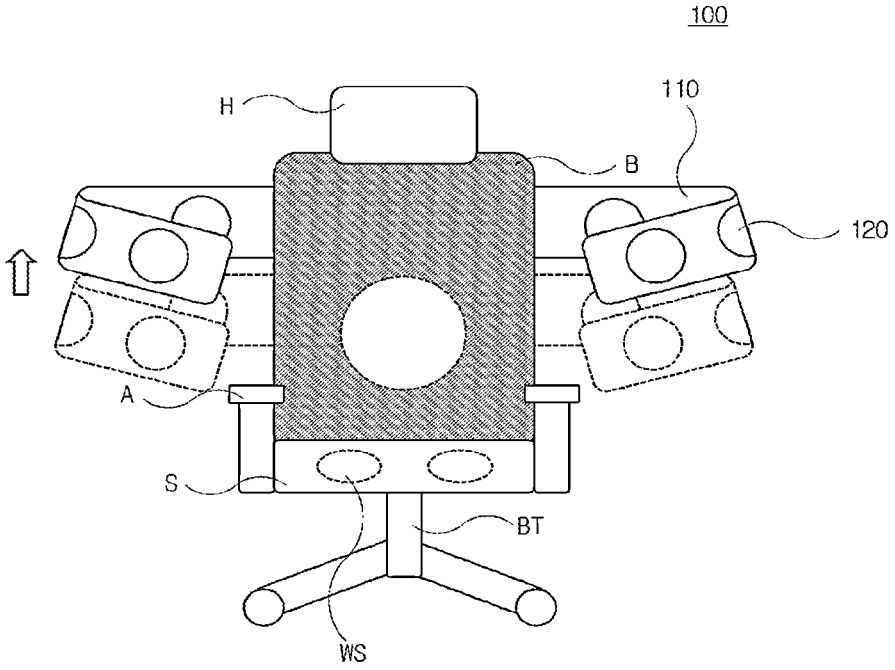
FIG. 9 is a front view of the chair according to yet another embodiment of the present invention.
Figure 10:
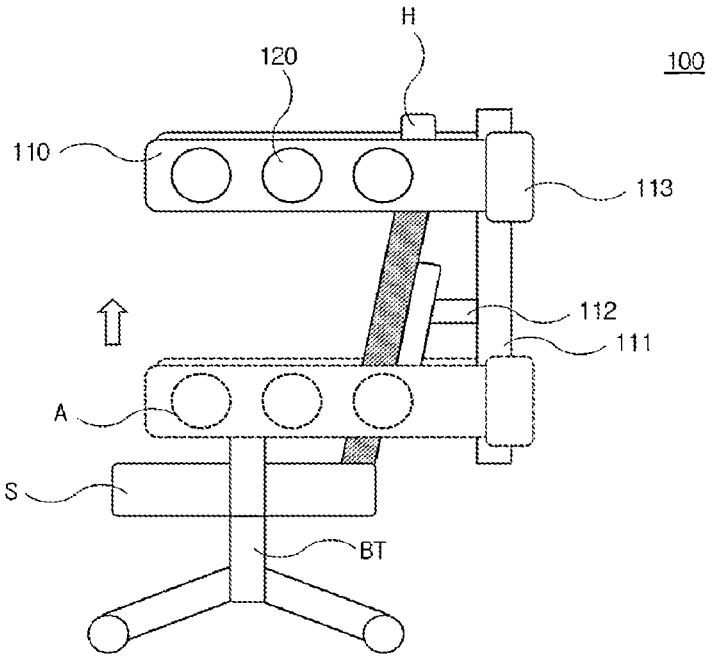
FIG. 10 is a lateral view of the chair according to yet another embodiment of the present invention.

FIGS. 9 and 10 illustrate a lifting/lowering operation of the main frame applied to the chair according to yet another embodiment of the present invention. The main frame 110 connected to the main frame rotating shaft 113 may, along with the main frame rotating shaft 113, move upward or downward in the direction in which the installation frame 111 extends.

A range in which the lifting/lowering operation of the main frame 110 occurs may be at least between the headrest portion H and the seat portion S, and when the main frame 110 moves upward to a position near the headrest portion H, positions at which sounds are generated from the speakers 120 provided in the main frame 110 may be at least in the vicinity of an ear of the user who sits in the chair 100.

Figure 11:
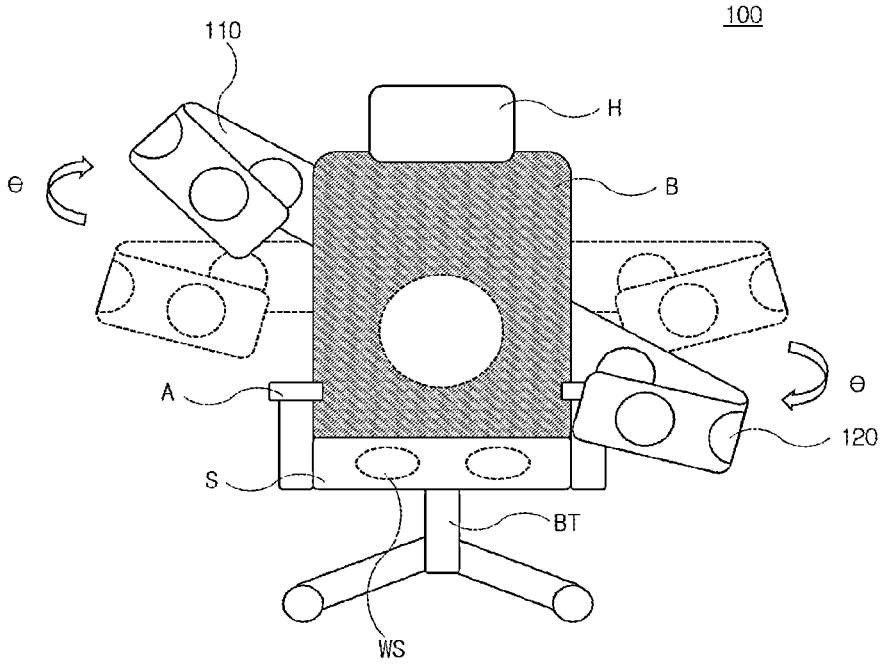
FIG. 11 is a front view of a chair according to yet another embodiment of the present invention.

FIG. 11 is a front view of a chair according to yet another embodiment of the present invention.

Referring to FIG. 11, the main frame 110 may be provided as a single member provided in a state of being connected to the above-described main frame rotating shaft 113 and may be provided to be rotatable within a predetermined angle range on a plane vertical to the ground. Here, in a case in which one end portion of the main frame 110 that is positioned at the left side of the chair 100 moves downward due to rotation, the other end portion of the main frame 10 that is positioned at the right side of the chair 100 moves upward due to rotation.

Figure 12:
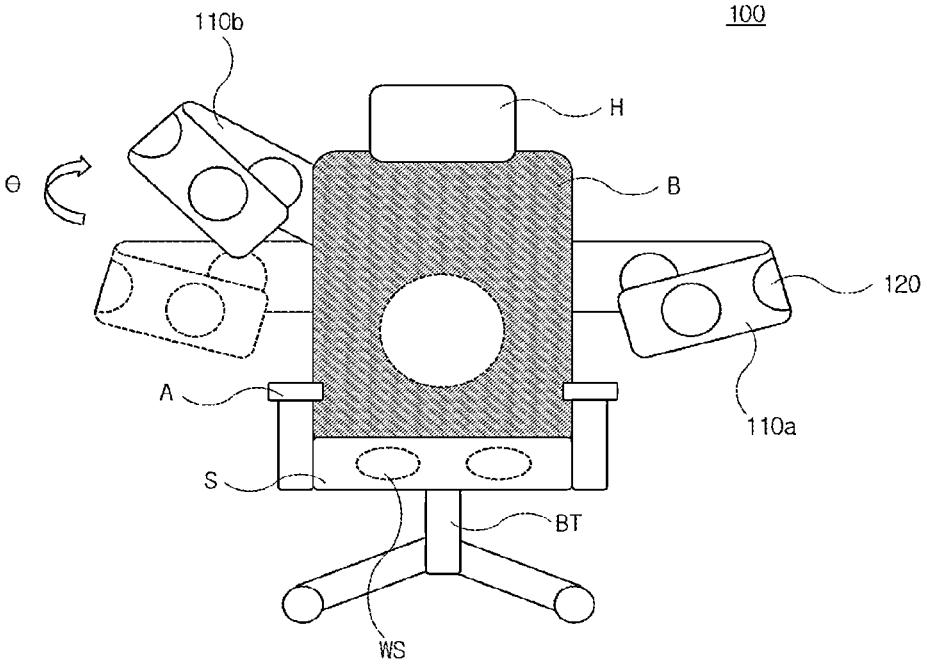
FIG. 12 is a front view of a chair according to yet another embodiment of the present invention.

FIG. 12 is a front view of a chair according to yet another embodiment of the present invention.

Referring to FIG. 12, the main frame 110 may be provided as two members, and here, the main frame 110 may include the first main frame 110*a* and the second main frame 110*b*. The first main frame 110*a* and the second main frame 110*b* may be individually connected to the above-described main frame rotating shafts 113*a* and 113*b*, respectively.

Accordingly, the first main frame 110*a* and the second main frame 110*b* may be provided to be independently rotatable within a predetermined angle range on a vertical plane.

Figure 13:
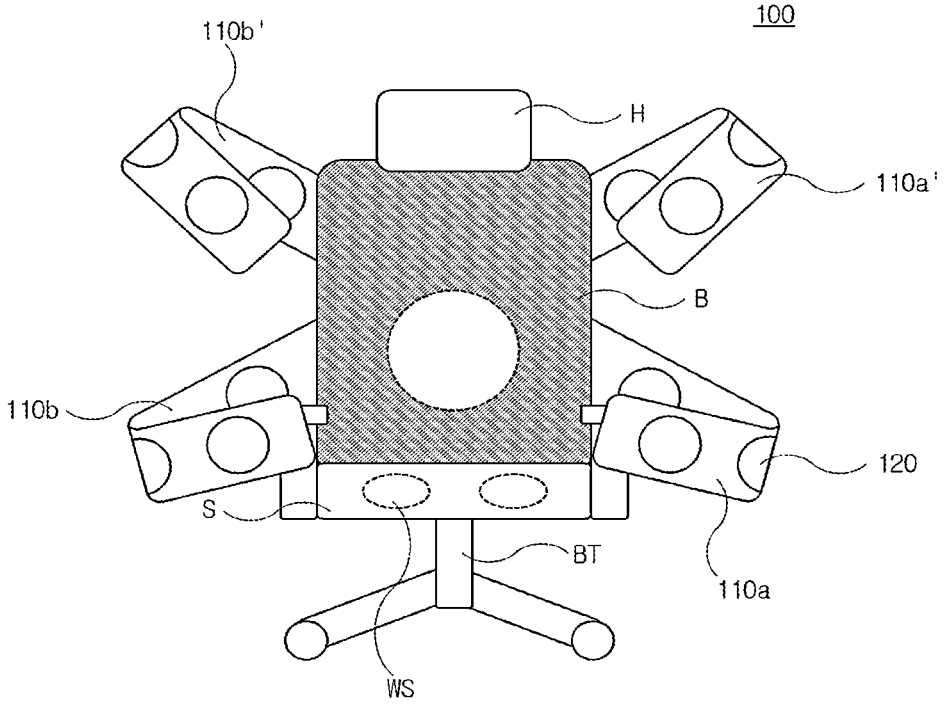
FIG. 13 is a front view of a chair according to yet another embodiment of the present invention.

FIG. 13 is a front view of a chair according to yet another embodiment of the present invention.

Referring to FIG. 13, the main frame 110 may be provided as two or four members. In a case in which the main frame 110 is provided as two members, the main frame 110 may include the first main frame 110*a* or 110*a*' and the second main frame 110*b* or 110*b*'. The first main frame 110*a* or 110*a*' and the second main frame 110*b* or 110*b*' may each be individually connected to the main frame rotating shafts.

Accordingly, the first main frame 110*a* or 110*a*' and the second main frame 110*b* or 110*b*' may be provided to be independently rotatable within a predetermined angle range on a vertical plane.

Meanwhile, as the first main frame 110*a* or 110*a*' and the second main frame 110*b* or 110*b*' are each divided into two main frames, the main frame 110 may be provided as a total of four members, and the four members may each be provided to be individually connected to the main frame rotating shafts to be independently rotatable within a predetermined angle range on a vertical plane.

Figure 14:
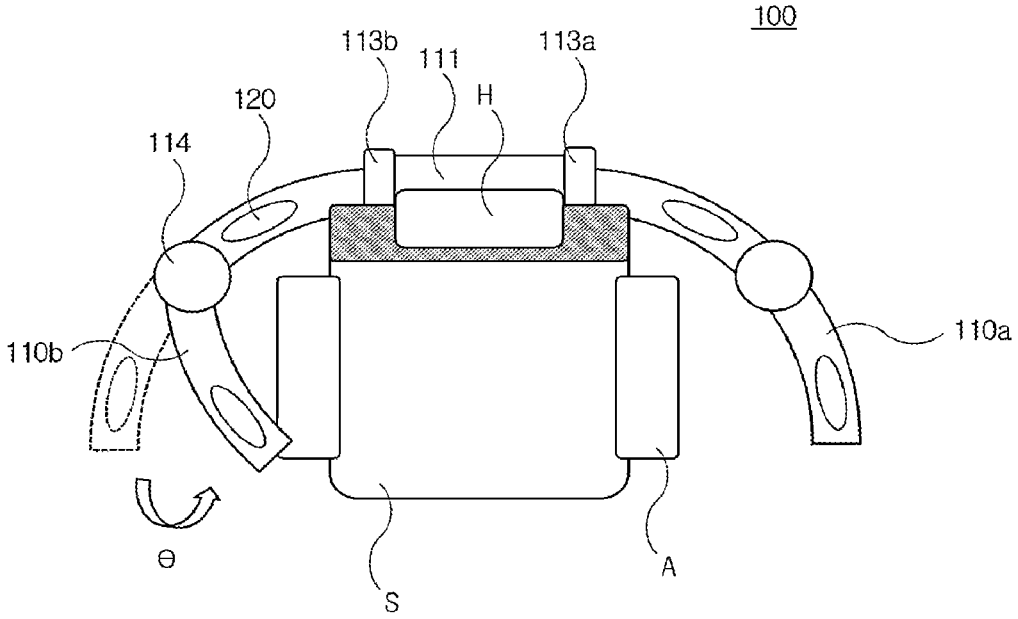
FIG. 14 is a top view of a chair according to yet another embodiment of the present invention.

FIG. 14 is a top view of a chair according to yet another embodiment of the present invention.

Referring to FIG. 14, the main frame 110, for example, the first main frame 110*a* and the second main frame 110*b*, may include a plurality of fragments connected with at least one joint member 114 as a medium in directions in which the first main frame 110*a* and the second main frame 110*b* extend. Here, each fragment may be a unit including at least one speaker 120.

The joint member 114 allows the plurality of fragments connected with the joint member 114 as a medium to be freely tilted in any direction. By allowing the plurality of fragments constituting the first main frame 110*a* and the second main frame 110*b* to be freely tilted in any direction by a user when necessary, it is possible to implement a sound environment optimized for the user.

Figure 15:
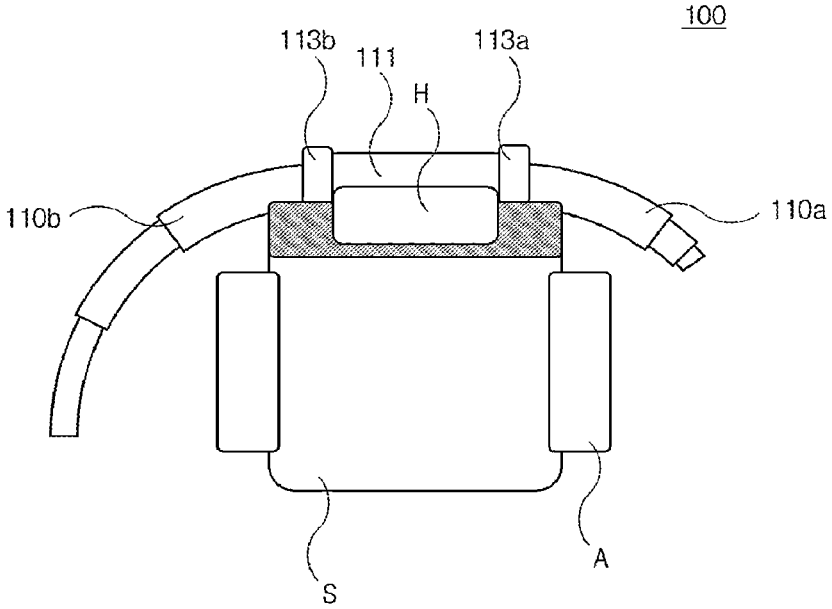
FIG. 15 is a top view of a chair according to yet another embodiment of the present invention.

FIG. 15 is a top view of a chair according to yet another embodiment of the present invention.

Referring to FIG. 15, the first main frame 110*a* and the second main frame 110*b* may be provided so that lengths at which the first main frame 110*a* and the second main frame 110*b* extend forward are adjustable from the backrest portion B or the main frame rotating shafts 113*a* and 113*b*. Here, the first main frame 110*a* and the second main frame 110*b* may have an end structure in which one end portion is able to be inserted or withdrawn in a multi-stage manner.

Figure 16:
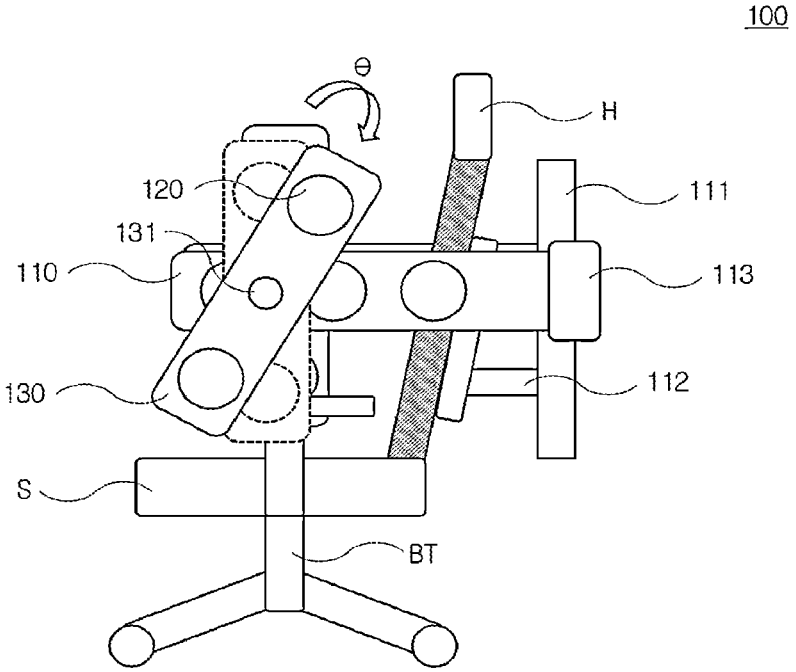
FIG. 16 is a lateral view of a chair according to yet another embodiment of the present invention.

FIG. 16 is a lateral view of a chair according to yet another embodiment of the present invention.

Referring to FIG. 16, at least one first sub-frame 130 may be disposed in a direction in which the main frame 110 (here, the main frame 110 includes the first main frame 110*a* and the second main frame 110*b*) extends. The first sub-frame 130 may have a shape that extends a predetermined length in a direction intersecting (preferably, vertically intersecting) the direction in which the main frame 110 extends.

In a case in which the first sub-frame 130 is disposed on the main frame 110, the first speaker installation area SA may be defined in at least one frame selected from the main frame 110 and the first sub-frame 130. That is, the first speaker installation area SA may be defined in both the main frame 110 and the first sub-frame 130, or the first speaker installation area SA may be defined in only the first sub-frame 130. In a case in which the first speaker installation area SA is defined in both the main frame 110 and the first sub-frame 130, a speaker installed in the speaker installation area defined in the main frame 110 and a speaker installed in the speaker installation area defined in the first sub-frame 130 may be provided at positions not overlapping each other.

Also, the first sub-frame 130 may be installed in arbitrary areas of the first main frame 110*a* and the second main frame 110*b* with a first sub-frame rotating shaft 131 as a medium, and here, the first sub-frame 130 may be provided to be connected to the first sub-frame rotating shaft 131 to be rotatable within a predetermined angle range on a vertical plane.

Figure 17:
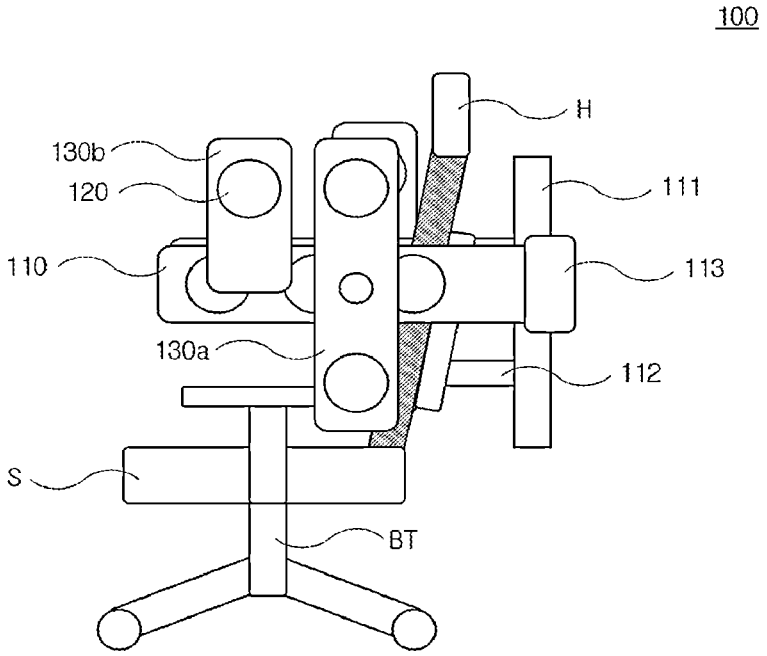
FIG. 17 is a lateral view of a chair according to yet another embodiment of the present invention.

Meanwhile, referring to FIG. 17 which is a lateral view of a chair according to yet another embodiment of the present invention, similarly to the chair illustrated in FIG. 16, a plurality of first sub-frames 130*a* and 130*b* may be disposed in the direction in which the main frame 110 (here, the main frame 110 includes the first main frame 110*a* and the second main frame 110*b*) extends. Here, the plurality of first sub-frames 130*a* and 130*b* may have different shapes and/or extension lengths.

Meanwhile, according to one embodiment of the present invention, the main frame 110 may be, instead of being installed on the headrest portion H of the chair 100, installed on the backrest portion B, the seat portion S, and/or the side support portions A.

Here, at least one head frame 140 having a shape that passes by a portion above the user sitting in the chair 100 and extends toward the front of the user may be installed on the main frame 110, the backrest portion B, or the headrest portion H.

Also, in a case in which the main frame 110 is installed on the installation frame 111, a first head frame 140 may also be installed on the installation frame 111 and have a shape that passes by a portion above the user sitting in the chair 100 and extends toward the front of the user.

Figure 18:
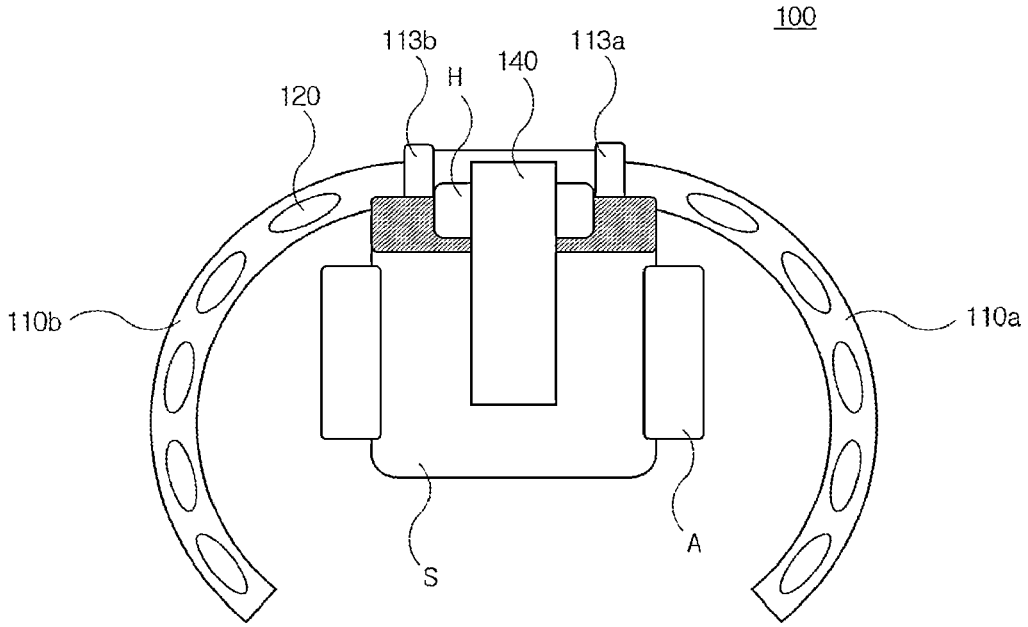
FIG. 18 is a top view of a chair according to yet another embodiment of the present invention.
Figure 19:
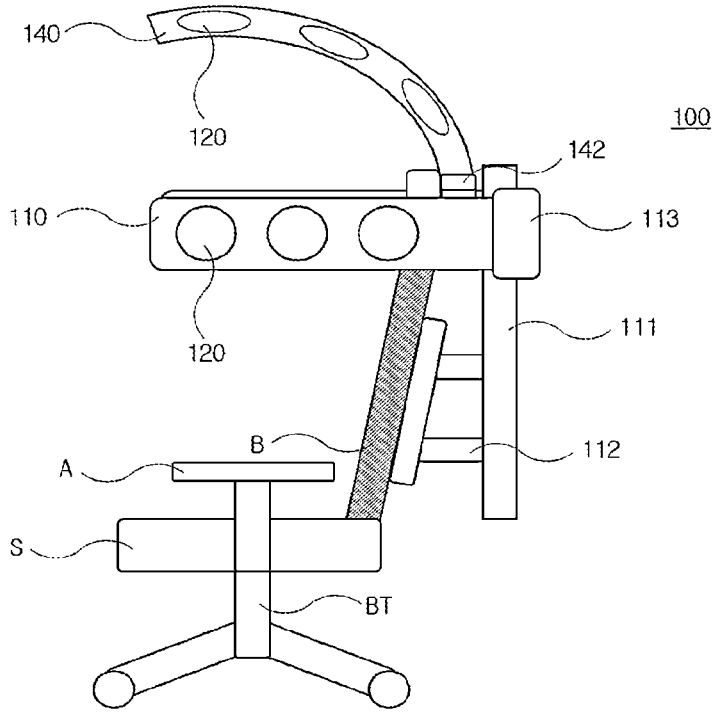
FIG. 19 is a lateral view of the chair illustrated in FIG. 18.

FIG. 18 is a top view of a chair according to yet another embodiment of the present invention, and FIG. 19 is a lateral view of the chair illustrated in FIG. 18.

Referring to FIGS. 18 and 19, at least one first head frame 140 that passes by a portion above the user sitting in the chair 100 and extends a predetermined length toward the front of the user is installed on the headrest portion H configured to support the head part of the user sitting in the chair 100.

Likewise, the second speaker installation area in which at least one speaker is installed may be defined in a direction in which the head frame 140 extends.

Figure 20:
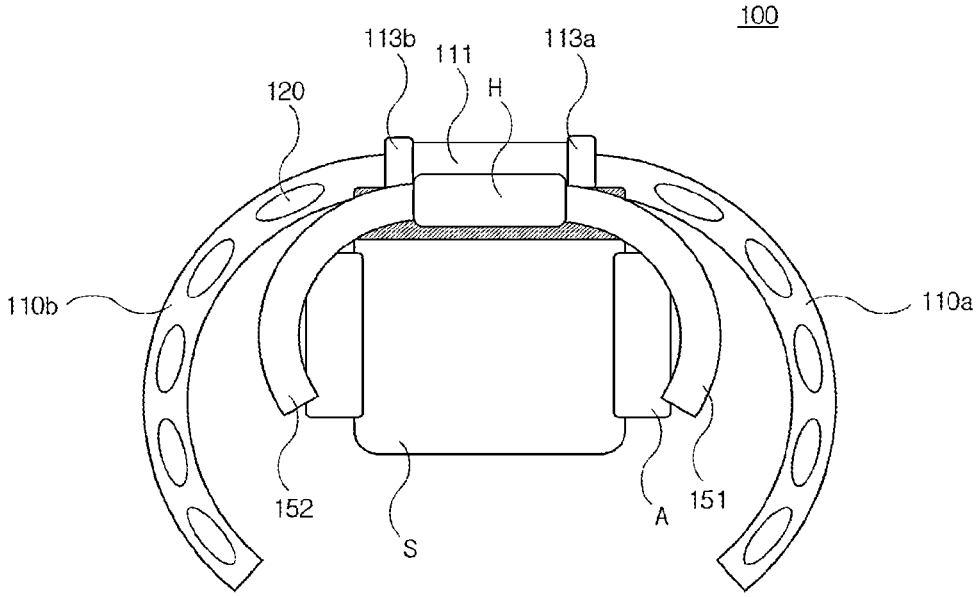
FIG. 20 is a top view of a chair according to yet another embodiment of the present invention.
Figure 21:
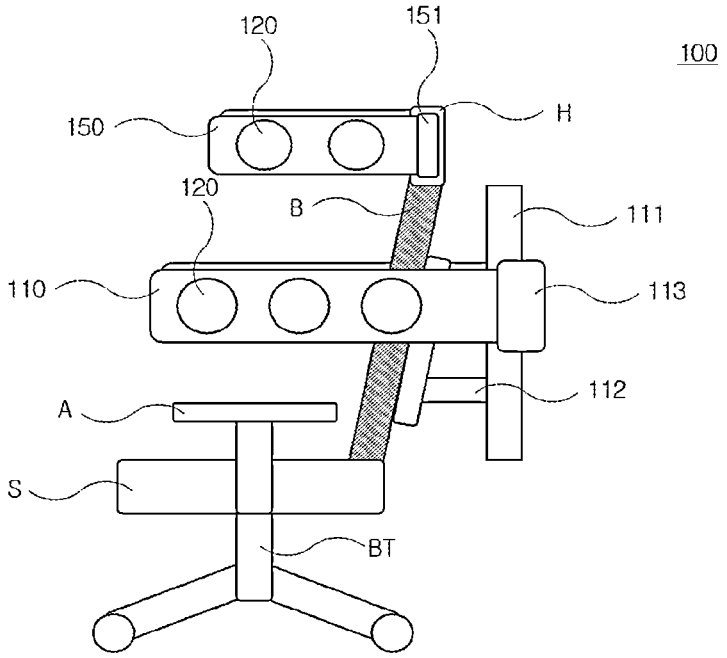
FIG. 21 is a lateral view of the chair illustrated in FIG. 20.
Figure 22:
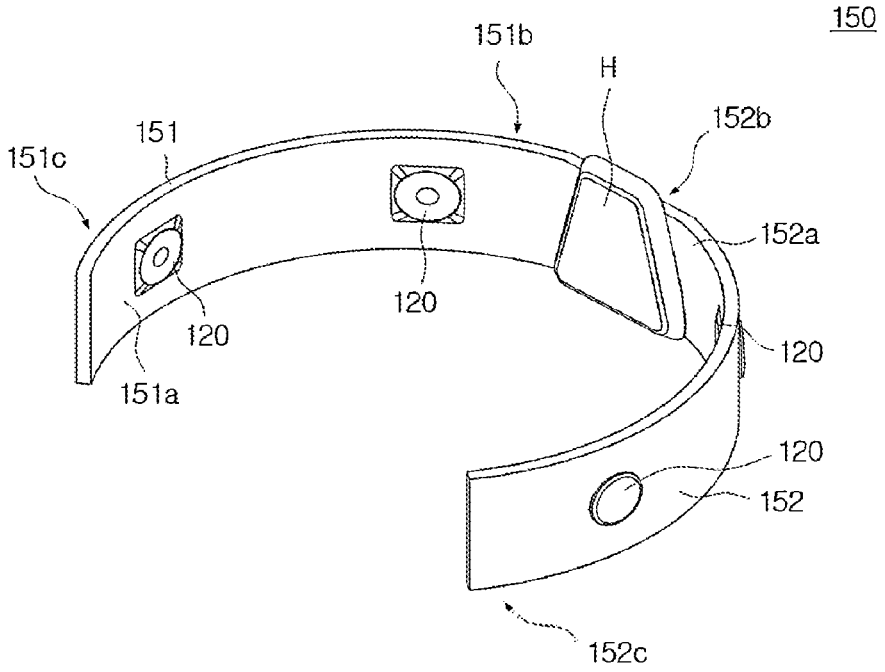
FIG. 22 is a perspective view illustrating one portion of a head frame applied to the chair illustrated in FIG. 20.

On the other hand, referring to FIGS. 20 and 21 illustrating a chair according to yet another embodiment of the present invention and FIG. 22 illustrating one portion of a head frame applied to the chair illustrated in FIG. 20, second and third head frames 150 include a second head frame 151 which is provided to extend in one direction of the headrest portion H and has at least one speaker 120 installed on an inner side 151*a* thereof and a third head frame 152 which is provided to extend in the other direction of the headrest portion H and has at least one speaker 120 installed on an inner side 152*a* thereof.

The second head frame 151 having a shape that extends in the one direction of the headrest portion H is provided on one side of the headrest portion H. At least one speaker 120 may be installed at the front or on the inner side 151*a* of the second head frame 151.

In a case in which at least two speakers 120 are installed on the inner side 151*a* of the second head frame 151, the two speakers 120 may be installed to be spaced apart from each other at a predetermined interval from one end 151*b* of the second head frame 151 fixed to the headrest portion H toward one end 151*c* of the second head frame 151 not fixed to the headrest portion H.

Likewise, the third head frame 152 having a shape that extends in the other direction of the headrest portion H is provided on the other side of the headrest portion H. At least one speaker 120 may be installed at the front or on the inner side 152*a* of the third head frame 152.

In a case in which at least two speakers 120 are installed on the inner side 152*a* of the third head frame 152, the two speakers 120 may be installed to be spaced apart from each other at a predetermined interval from one end 152*b* of the third head frame 152 fixed to the headrest portion H toward the other end 152*c* of the third head frame 152 not fixed to the headrest portion H.

In one embodiment, the one end 151*b* of the second head frame 151 and the one end 152*b* of the third head frame 152 may be installed to be fixed to both sides of the headrest portion H, and the one end 151*c* of the second head frame 151 and the other end 152*c* of the third head frame 152, which are not fixed to the headrest portion H, may be provided to be inclined toward the front or inside of the headrest portion H.

In this way, by being provided to be inclined toward the front or inside of the headrest portion H, the one end 151*c* of the second head frame 151 and the other end 152*c* of the third head frame 152, which are not fixed to the headrest portion H, may allow sounds output from a plurality of speakers 120 installed in the second head frame 151 and the third head frame 152 to be further concentrated on the user.

Also, as the one end 151*c* of the second head frame 151 and the other end 152*c* of the third head frame 152, which are not fixed to the headrest portion H, are provided to be inclined toward the front or inside of the headrest portion H, it is possible to maintain a constant distance between the plurality of speakers 120 and the user who sits in the chair in which the second and third head frames 150 are installed.

The second head frame 151 and the third head frame 152 may have a shape that is bent or curved from the headrest portion H toward the front of the chair or may have a linear shape or an angular shape which has at least one joint structure in the middle.

Here, the one end 151*c* of the second head frame 151 and the other end 152*c* of the third head frame 152, which are not fixed to the headrest portion H, may be arranged to be inclined from the headrest portion H toward the front of the chair.

As described above, by the second head frame 151 and the third head frame 152 installed to extend from both sides of the headrest portion H and the plurality of speakers 120 installed in the second head frame 151 and the third head frame 152, a multi-channel sound system may be implemented by receiving and outputting a multi-channel sound signal from a separately-provided sound source (e.g., home theater, TV, set-top box, sound bar, computer, cellular phone, tablet PC, or the like).

Also, the second head frame 151 and the third head frame 152 may be integrally configured.

Figure 23A:
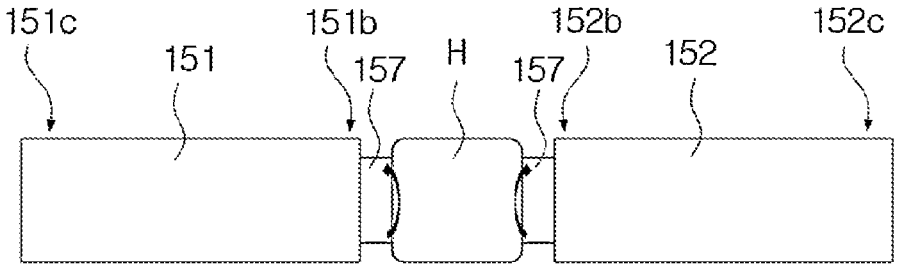
FIGS. 23A to 23C are front views illustrating one portion of the head frame applied to the chair illustrated in FIG. 20.
Figure 23B:
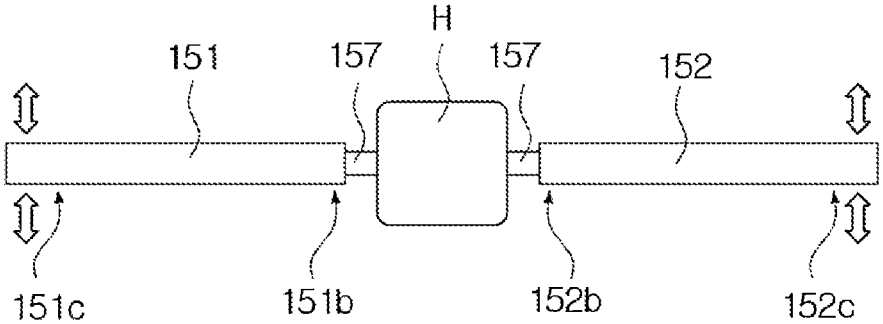
Figure 23C:
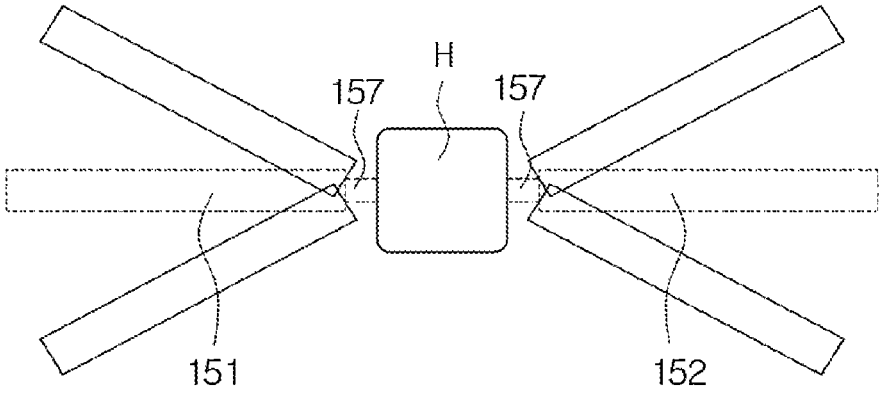

FIGS. 23A to 23C illustrate one portion of the head frame applied to the chair illustrated in FIG. 20 and schematically illustrates an operation of a speaker installed in the head frame.

Referring to FIGS. 23A to 23C, the one end 151*b* of the second head frame 151 and the one end 152*b* of the third head frame 152 may be installed to be rotatable about a joint of the headrest portion H.

Specifically, the second head frame 151 and the third head frame 152 are rotatable in the extending directions thereof (see FIGS. 23A and 23B).

Also, here, joint portions 157 may allow the second head frame 151 and the third head frame 152 to be freely bendable with respect to the headrest portion H (see FIG. 23C).

Accordingly, when a user sits in the chair in which the second and third head frames 150 are installed or stands up from the chair, the directions and positions of the second head frame 151 and the third head frame 152 may be adjusted so as not to interfere with the user. In another case, the directions of the second head frame 151 and the third head frame 152 may be adjusted through manual adjustment by the user or automatic adjustment by a separate algorithm, and in this way, it may be possible to further optimize the directions in a state in which the user sits in the chair and to create a sound environment customized for the user.

Figure 24:
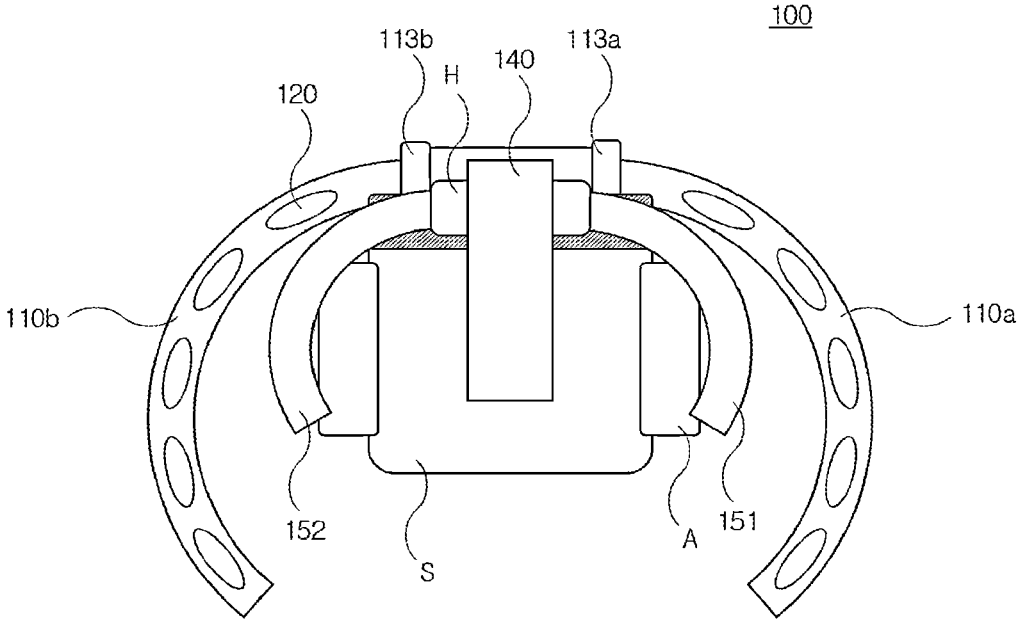
FIG. 24 is a top view of a chair according to yet another embodiment of the present invention.
Figure 25:
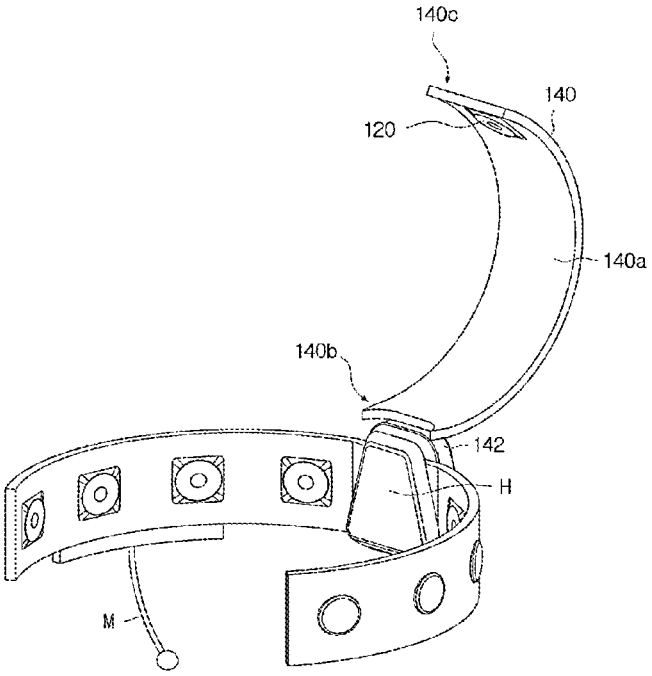
FIGS. 25 and 26 are perspective views illustrating one portion of a head frame applied to the chair illustrated in FIG. 24.
Figure 26:
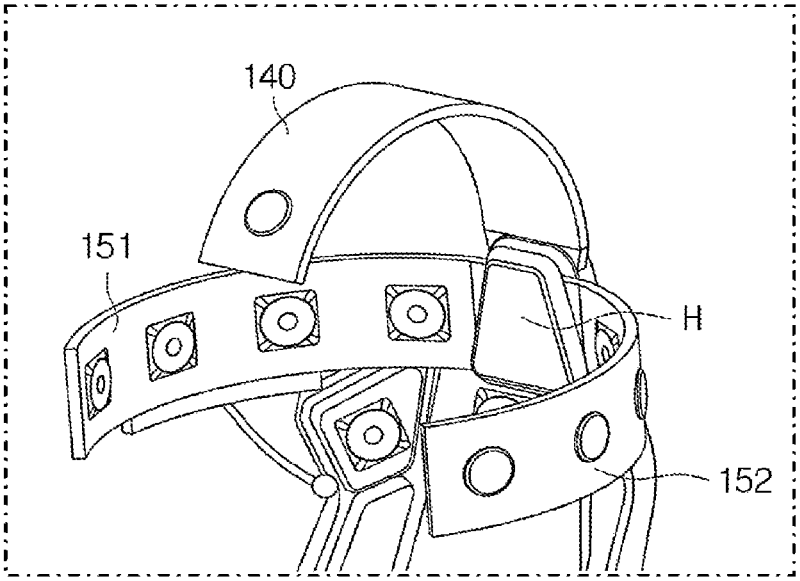

FIG. 24 is a top view of a chair according to yet another embodiment of the present invention, and FIGS. 25 and 26 are perspective views illustrating one portion of a head frame applied to the chair illustrated in FIG. 24.

Referring to FIGS. 24 to 26, the second head frame 151 and the third head frame 152 are provided to extend from both sides of the headrest portion H, and above the headrest portion H, a first head frame 140 which is provided to extend in a direction toward a portion above the headrest portion H and which has a first speaker installation area in which at least one speaker 120 is installed defined on an inner side 140*a* may be installed.

Here, a sound input device M may be provided in at least one selected from the second head frame 151 and the third head frame 152. Meanwhile, although not separately illustrated in the drawings, the sound input device M may also be provided in the main frame 110.

In the present embodiment, the first head frame 140 having a shape that extends toward the front of the headrest portion H is provided above the headrest portion H. Instead of being installed above the headrest portion H, the first head frame 140 may be installed on a front surface, a rear surface, or an inside of the headrest portion H.

At least one speaker 120 may be installed on the inner side 140*a* of the first head frame 140. In a case in which at least two speakers 120 are installed on the inner side 140*a* of the first head frame 140, the two speakers 120 may be installed to be spaced apart from each other at a predetermined interval from one end 140*b* of the first head frame 140 fixed to the headrest portion H toward the other end 140*c* of the first head frame 140 not fixed to the headrest portion H.

In one embodiment, the one end 140*b* of the first head frame 140 may be installed to be fixed to an upper portion of the headrest portion H, and the other end 140*c* of the first head frame 140 not fixed to the headrest portion H may have a shape that is bent or curved toward the front of the headrest portion H or may have a linear shape or an angular shape which has at least one joint structure in the middle.

In this way, by being provided to be inclined toward the front of the headrest portion H, the other end 140*c* of the first head frame 140 not fixed to the headrest portion H may allow sounds output from the at least one speaker 120 installed in the first head frame 140 to be further concentrated on the user.

Also, in a case in which the speaker 120 installed in the first head frame 140 is provided as a plurality of speakers 120, as the other end 140*c* of the first head frame 140 not fixed to the headrest portion H is provided to be inclined toward the front of the headrest portion H, it is possible to maintain a constant distance between the plurality of speakers 120 installed in the first head frame 140 and the user who sits in the chair. In particular, in this case, a constant distance can be maintained not only between the speakers 120 installed in the first head frame 140 and the user but also between the plurality of speakers 120 installed in the second head frame 151 and the third head frame 152 and the user.

As described above, by the first head frame 140 installed to extend to a portion above the headrest portion H and the at least one speaker 120 installed in the first head frame 140, a multi-channel sound system may be implemented by receiving and outputting a multi-channel sound signal from a separately-provided sound source (e.g., home theater, TV, set-top box, sound bar, computer, cellular phone, tablet PC, or the like).

Also, the second head frame 151 and the third head frame 152 may be integrally configured, and here, the first head frame 140, the second head frame 151, and the third head frame 152 may be integrally configured.

In yet another embodiment, the one end 140*b* of the first head frame 140 may be installed to be hinge-rotatable about the headrest portion H with a hinge portion 142 as a medium.

In this case, when a user sits in the chair in which the first head frame 140 is installed or stands up from the chair, the direction of the first head frame 140 may be adjusted so as not to interfere with the user. In another case, the direction of the first head frame 140 may be adjusted through manual adjustment by the user or automatic adjustment by a separate algorithm, and in this way, it may be possible to further optimize the direction in a state in which the user sits in the chair and to create a sound environment customized for the user.

Figure 27:
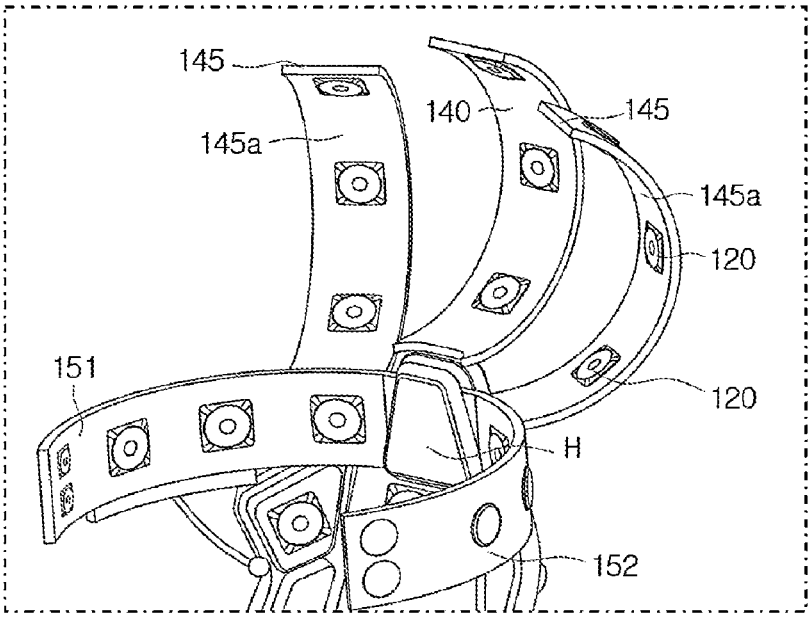
FIGS. 27 and 28 illustrate modified examples of the head frame applied to the chair illustrated in FIG. 24.

FIG. 27 illustrates a modified example of the head frame applied to the chair illustrated in FIG. 24.

Referring to FIG. 27, at least one fourth head frame 145 may be installed in at least one area selected from an area between the second head frame 151 and the first head frame 140 and an area between the third head frame 152 and the first head frame 140.

In the present embodiment, the fourth head frame 145 having a shape that extends toward the front of the headrest portion H is provided in at least one area selected from the area between the second head frame 151 and the first head frame 140 and the area between the third head frame 152 and the first head frame 140. At least one speaker 120 may be installed on an inner side 145*a* of the fourth head frame 145.

In a case in which at least two speakers 120 are installed on the inner side 145*a* of the fourth head frame 145, the two speakers 120 may be installed to be spaced apart from each other at a predetermined interval from one end of the fourth head frame 145 fixed to the headrest portion H toward the other end of the fourth head frame 145 not fixed to the headrest portion H.

In one embodiment, the one end of the fourth head frame 145 may be installed to be fixed to the headrest portion H, and the other end of the fourth head frame 145 not fixed to the headrest portion H may have a shape that is bent or curved toward the front of the headrest portion H or may have a linear shape or an angular shape which has at least one joint structure in the middle.

In this way, by being provided to be inclined toward the front of the headrest portion H, the other end of the fourth head frame 145 not fixed to the headrest portion H may allow sounds output from the at least one speaker 120 installed in the fourth head frame 145 to be further concentrated on the user.

Also, in a case in which the speaker 120 installed in the fourth head frame 145 is provided as a plurality of speakers 120, as the other end of the fourth head frame 145 not fixed to the headrest portion H is provided to be inclined toward the front of the headrest portion H, it is possible to maintain a constant distance between the plurality of speakers 120 installed in the fourth head frame 145 and the user who sits in the chair. In particular, in this case, a constant distance can be maintained not only between the speakers 120 installed in the fourth head frame 145 and the user but also between the plurality of speakers 120 installed in the second head frame 151, the third head frame 152 and the first head frame 140 and the user.

As described above, by the fourth head frame 145 installed to extend to a portion above the headrest portion H and the at least one speaker 120 installed in the fourth head frame 145, a multi-channel sound system may be implemented by receiving and outputting a multi-channel sound signal from a separately-provided sound source (e.g., home theater, TV, set-top box, sound bar, computer, cellular phone, tablet PC, or the like).

In yet another embodiment, the one end of the fourth head frame 145 may be installed to be hinge-rotatable about the headrest portion H like the one end 140*b* of the first head frame 140.

In this case, when a user sits in the chair 100 or stands up from the chair 100, the direction of the fourth head frame 145 may be adjusted so as not to interfere with the user. In another case, the direction of the fourth head frame 145 may be adjusted through manual adjustment by the user or automatic adjustment by a separate algorithm, and in this way, it may be possible to further optimize the direction in a state in which the user sits in the chair and to create a sound environment customized for the user.

Figure 28:
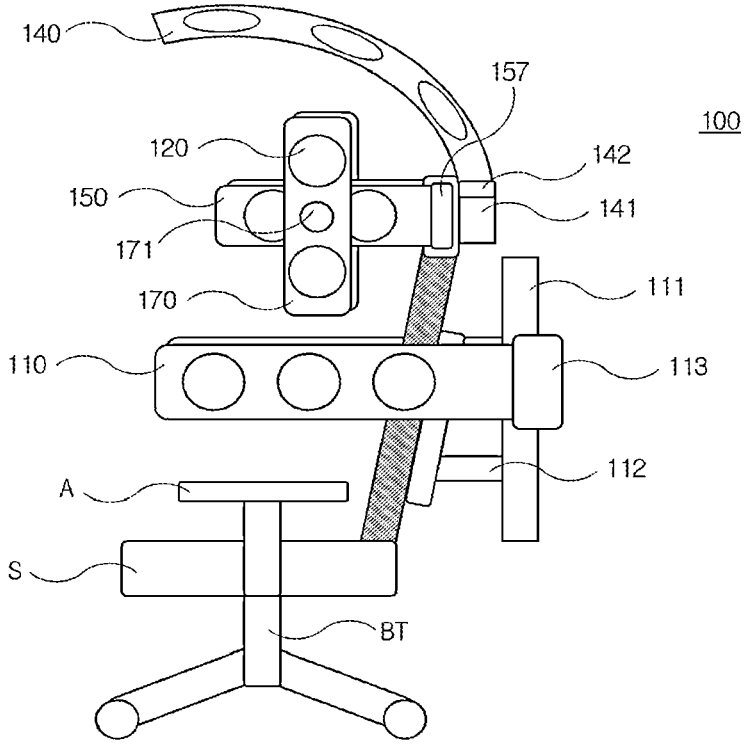

FIG. 28 illustrates another modified example of the head frame applied to the chair illustrated in FIG. 24.

Referring to FIG. 28, at least one second sub-frame 170 may be disposed in directions in which the second and third head frames 150 extend. The second sub-frame 170 may have a shape that extends a predetermined length in a direction intersecting (preferably, vertically intersecting) the directions in which the second and third head frames 150 extend.

As in the second and third head frames 150, the second speaker installation area in which at least one speaker 120 is installed may be defined in a direction in which the second sub-frame 170 extends.

Also, the second sub-frame 170 may be installed in arbitrary areas of the second and third head frames 150 with a second sub-frame rotating shaft 171 as a medium, and here, the second sub-frame 170 may be provided to be connected to the second sub-frame rotating shaft 171 to be rotatable within a predetermined angle range on a plane vertical to the ground.

Meanwhile, one end portion of the first head frame 140 may be installed to be hinge-rotatable about the headrest portion H with the hinge portion 142 as a medium. Also, the one end portion of the first head frame 140 and the hinge portion 142 may be connected to a lifting/lowering portion 141. The first head frame 140 may be able to move upward a predetermined height by the lifting/lowering portion 141.

Figure 29:
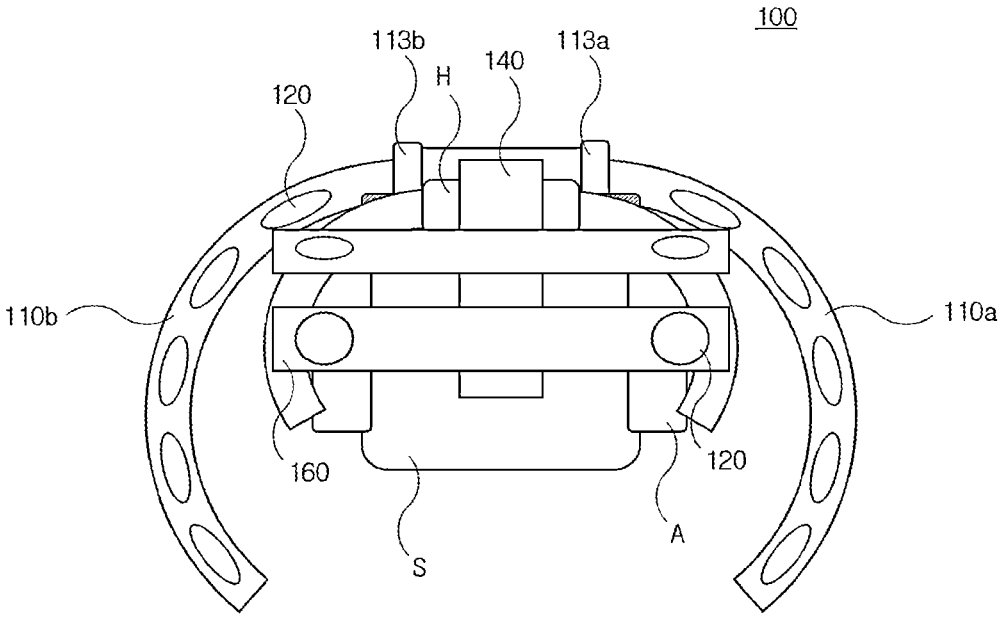
FIG. 29 is a top view of a chair according to yet another embodiment of the present invention.
Figure 30:
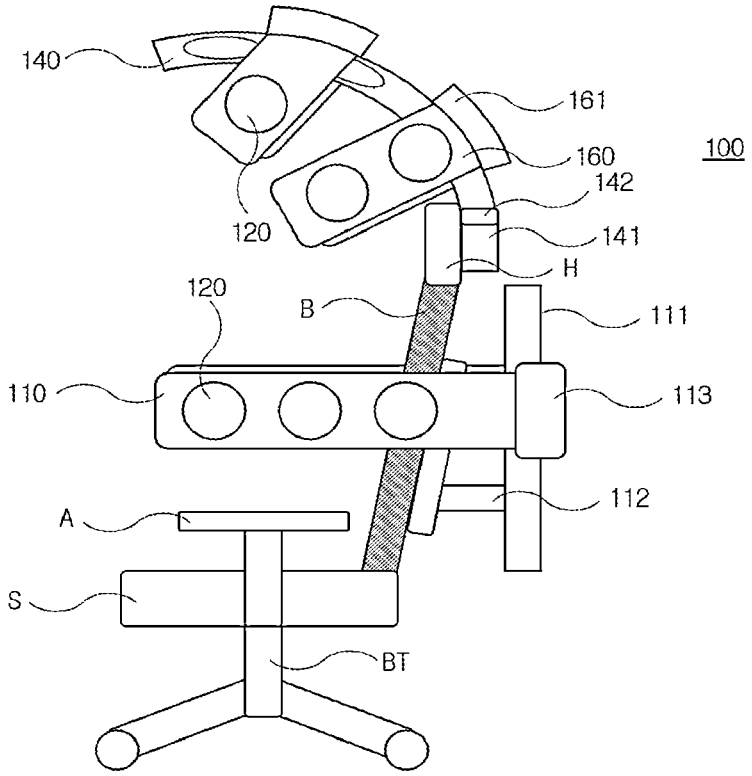
FIG. 30 is a lateral view of the chair illustrated in FIG. 29.

FIG. 29 is a top view of a chair according to yet another embodiment of the present invention, and FIG. 30 is a lateral view of the chair illustrated in FIG. 29.

Referring to FIGS. 29 and 30, at least one second sub-frame 160 may be disposed in a direction in which the first head frame 140 extends. The second sub-frame 160 may have a shape that extends a predetermined length in a direction intersecting (preferably, vertically intersecting) the direction in which the first head frame 140 extends.

For example, a length at which the second sub-frame 160 extends may be provided as a length to the headrest portion H from a position where the second sub-frame 160 is installed on the first head frame 140 or a length to the seat portion S from the position where the second sub-frame 160 is installed on the first head frame 140. Accordingly, the speaker 120 installed in the second sub-frame 160 may output sounds from a side or a lower side of the user who sits in the chair 100.

As in the first head frame 140, the second speaker installation area in which at least one speaker 120 is installed may be defined in a direction in which the second sub-frame 160 extends.

Although not separately illustrated in the drawings, the second sub-frame 160 may also be installed on the first head frame 140 with a second sub-frame rotating shaft as a medium, and the second sub-frame 160 may be provided to be connected to the second sub-frame rotating shaft to be rotatable within a predetermined angle range in an axial direction of the second sub-frame rotating shaft.

Also, in this case, the second speaker installation area may be defined in at least one frame selected from the first head frame 140 and the second sub-frame 160.

Figure 31:
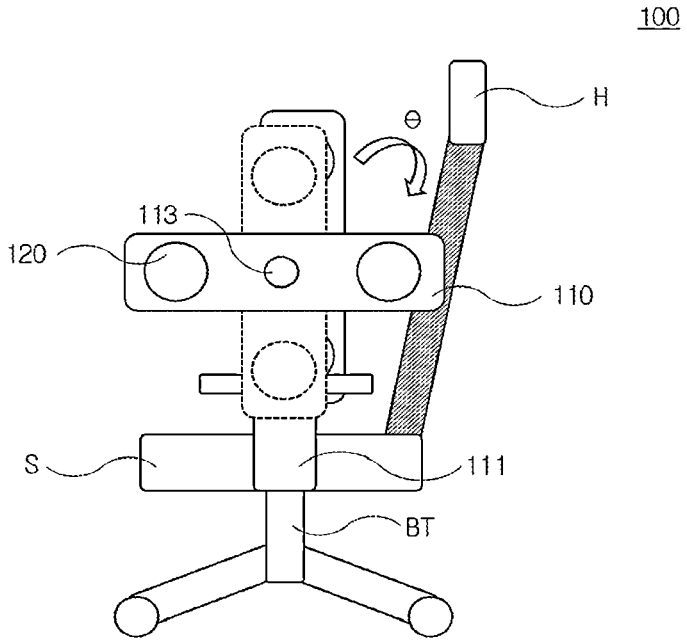
FIG. 31 is a lateral view of a chair according to yet another embodiment of the present invention.

FIG. 31 is illustrates a modified example of the chair illustrated in FIG. 1.

Referring to FIG. 31, the installation frame 111 having a shape that extends in the vertical direction may be provided on the side support portions A, and the main frame 110 may be installed on the installation frame 111 with the main frame rotating shaft 113 as a medium. Here, the main frame 110 may be provided to be connected to the main frame rotating shaft 113 to be rotatable within a predetermined angle range in the axial direction of the main frame rotating shaft 113.

In a case in which the main frame 110 is rotatably installed on the installation frame 111 provided on the side support portions A, the first speaker installation area SA may be defined not only in the main frame 110 but also in the side support portion A. In a case in which the first speaker installation area SA is defined in both the main frame 110 and the side support portion A, a speaker installed in the speaker installation area defined in the main frame 110 and a speaker installed in the speaker installation area defined in the side support portion A may be provided at positions not overlapping each other.

Figure 32:
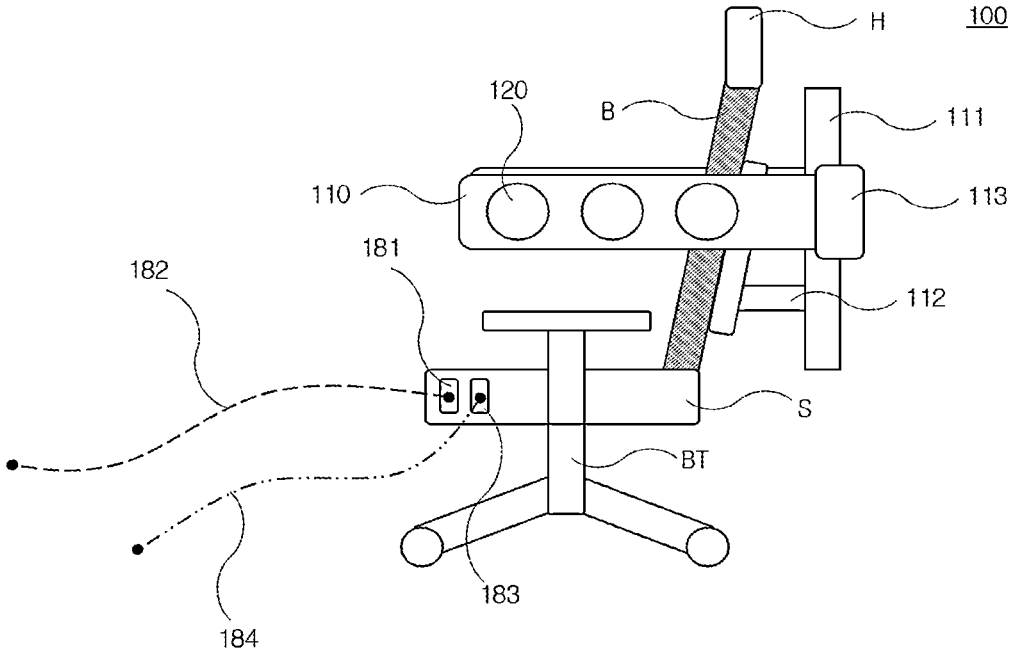
FIG. 32 is a lateral view of a chair according to yet another embodiment of the present invention.

FIG. 32 illustrates a modified example of the chair illustrated in FIG. 1.

Referring to FIG. 32, the chair 100 may further include a binding portion 181 configured to bind the chair 100 to an arbitrary structure. For example, the binding portion 181 may bind the chair 100 to a structure such as furniture, a desk, or the like with a binding cable 182 as a medium to limit the movement radius of the chair 100.

Also, the chair 100 may include a reception portion 183 to allow the speaker 120 installed in the main frame 110 to receive sound signals through wires. A reception cable 184 extending from the reception portion 183 may receive sound signals by being directly connected to an audio source (e.g., home theater, TV, set-top box, sound bar, computer, cellular phone, tablet PC, or the like) or being connected to an audio relay source configured to receive sound signals wirelessly from the audio source. Meanwhile, the reception portion 183 may receive sound signals wirelessly without using the reception cable 184.

In a case in which the chair 100 moves excessively in a state in which the reception cable 184 is connected to the audio source or the audio relay source, there is a concern of damage to the reception cable 184, the reception portion 183 or the audio source to which the reception cable 184 is connected, and the like, and such a problem can be prevented by binding the chair 100 to an arbitrary structure and limiting the movement radius of the chair 100 using the binding cable 182.

Meanwhile, the binding portion 181 and the reception portion 183 may be integrally provided unlike those illustrated in FIG. 32. In this case, the binding cable 182 and the reception cable 184 may be integrally provided or provided to have different lengths.

Also, although not separately illustrated in the drawings, a channel processing device, such as a receiver, in charge of reception, amplification, transmission, and the like of a multi-channel sound signal may be provided in an arbitrary area of the chair 100, and the audio source may be connected to the channel processing device to output a multi-channel sound signal corresponding to channels provided in the chair 100.

Figure 33:
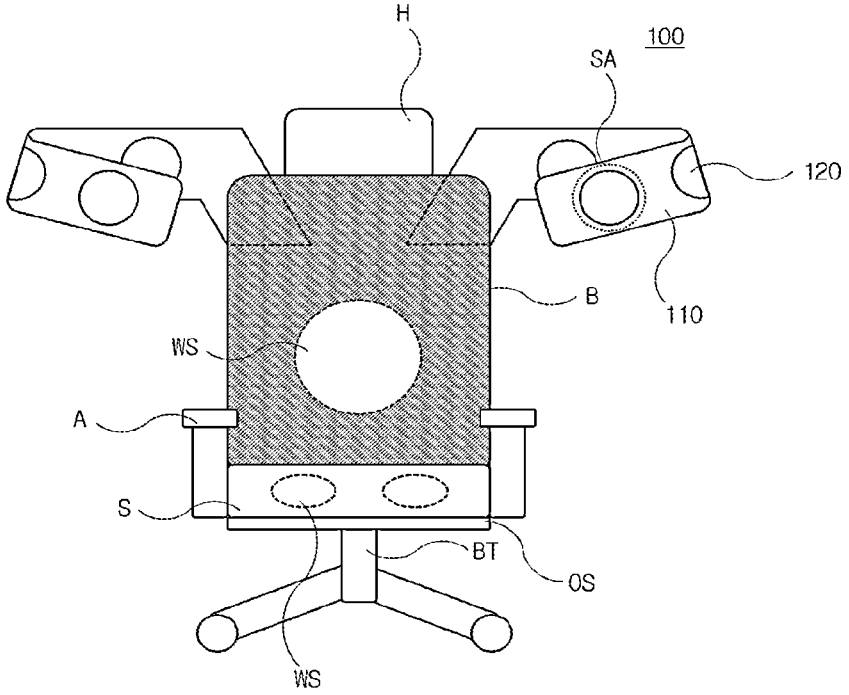
FIG. 33 is a front view of a chair according to yet another embodiment of the present invention.

FIG. 33 is a front view of a chair according to yet another embodiment of the present invention.

Referring to FIG. 33, at least one main frame 110 extending a predetermined length toward a front may be installed on the backrest portion B, and a first speaker installation area SA in which at least one speaker 120 is installed may be defined in a direction in which the main frame 110 extends. Here, the main frame 110 may be directly installed on a rear surface of the backrest portion B.

Meanwhile, the main frame 110 may have a shape that extends a predetermined length toward the front of the chair 100 while at a predetermined height upward from one end portion installed at the backrest portion B.

Embodiments of the present invention have been described above, but those of ordinary skill in the art may make various modifications and changes to the present invention by adding, changing, or omitting components within the scope not departing from the spirit of the present invention, and such modifications and changes also belong to the scope of rights of the present invention.

What is claimed is:

1. A chair including at least 1) a headrest portion configured to support a head part of a user, 2) a backrest portion configured to support a back and waist part of the user, 3) a seat portion configured to support a buttocks part and a part of legs of the user, and 4) side support portions configured to support sides of the user, the chair comprising:

at least one main frame which is installed on the backrest portion of the chair and has a shape that passes by a side of the user sitting in the chair and extends toward a front of the user, wherein the main frame has a shape that is bent from the backrest portion toward a front of the chair, and wherein the main frame includes:

at least one first main frame having a shape that passes by a left side of the user sitting in the chair and extends toward the front of the user; and at least one second main frame having a shape that passes by a right side of the user sitting in the chair and extends toward the front of the user;

a first speaker installation area in which at least one speaker is installed is defined in a direction in which the first main frame extends and the second main frame extends.

2. The chair of claim 1, wherein:

a main frame rotating shaft is provided inside or behind the backrest portion; and the main frame is provided to be connected to the main frame rotating shaft to be rotatable within a predetermined angle range in an axial direction of the main frame rotating shaft.

3. The chair of claim 1, wherein:

an installation frame having a shape that extends in a vertical direction is provided inside or behind the backrest portion; and the main frame is provided to be connected to the installation frame to be able to move upward or downward in a direction in which the installation frame extends.

4. The chair of claim 3, wherein:

the main frame is installed on the installation frame with a main frame rotating shaft as a medium; and the main frame is provided to be connected to the main frame rotating shaft to be rotatable within a predetermined angle range in an axial direction of the main frame rotating shaft.

5. The chair of claim 1, wherein:

a main frame rotating shaft is provided inside or behind the backrest portion; and the first main frame and the second main frame are provided to be connected to the main frame rotating shaft to be rotatable within a predetermined angle range in an axial direction of the main frame rotating shaft.

6. The chair of claim 1, wherein a length at which the main frame extends is provided to be adjustable.

7. The chair of claim 1, wherein the main frame is provided to be able to tilt in a front-rear direction or a vertical direction.

8. The chair of claim 1, wherein:

the main frame includes a plurality of fragments connected with at least one joint member as a medium in the direction in which the main frame extends; and the fragments are provided to be able to be freely tilted in any direction with the joint member as a medium.

9. The chair of claim 1, wherein:

at least one speaker is installed in the first speaker installation area defined in the main frame; and the speaker is provided to be able to slide in the direction in which the main frame extends.

10. The chair of claim 1, wherein:

at least one speaker is installed in the first speaker installation area defined in the main frame; and the speaker is provided to be rotatable in an arbitrary axial direction.

11. The chair of claim 1, wherein:

at least one first sub-frame is disposed in the direction in which the main frame extends;

the first sub-frame has a shape that extends a predetermined length in a direction intersecting the direction in which the main frame extends; and the first speaker installation area is defined in at least one frame selected from the main frame and the first sub-frame.

12. The chair of claim 11, wherein:

the first sub-frame is installed on the main frame with a first sub-frame rotating shaft as a medium; and the first sub-frame is provided to be connected to the first sub-frame rotating shaft to be rotatable within a predetermined angle range in an axial direction of the first sub-frame rotating shaft.

13. The chair of claim 1, wherein the main frame is installed on the chair with a support member as a medium.

14. The chair of claim 1, wherein:

at least one head frame having a shape that passes by a portion above the user sitting in the chair and extends toward the front of the user is installed on the headrest portion; and a second speaker installation area in which at least one speaker is installed is defined in a direction in which the head frame extends.

15. The chair of claim 14, wherein:

at least one second sub-frame is disposed in the direction in which the head frame extends;

the second sub-frame has a shape that extends a predetermined length in a direction intersecting the direction in which the head frame extends; and the second speaker installation area is defined in at least one frame selected from the head frame and the second sub-frame.

16. The chair of claim 15, wherein:

the second sub-frame is installed on the head frame with a second sub-frame rotating shaft as a medium; and the second sub-frame is provided to be connected to the second sub-frame rotating shaft to be rotatable within a predetermined angle range in an axial direction of the second sub-frame rotating shaft.

* * * * *